US010962295B2

(12) United States Patent
Nitta

(10) Patent No.: US 10,962,295 B2
(45) Date of Patent: Mar. 30, 2021

(54) HEAT EXCHANGE APPARATUS HAVING A PLURALITY OF MODULAR FLOW PATH ASSEMBLIES, ENCASED IN A CORE BODY WITH A PLURALITY OF CORRESPONDING FLOW PATH ASSEMBLY SEATS, PROVIDING MEANS FOR INDEPENDENT POSITIONING AND AXIAL ALIGNMENT FOR A DESIRED EFFECT

(71) Applicant: Takeyoshi Nitta, Upland, CA (US)

(72) Inventor: Takeyoshi Nitta, Upland, CA (US)

(73) Assignee: Mikutay Corporation, Ontario, CA (US)

( * ) Notice: Subject to any disclaimer, the term of this patent is extended or adjusted under 35 U.S.C. 154(b) by 225 days.

(21) Appl. No.: 16/282,954

(22) Filed: Feb. 22, 2019

(65) Prior Publication Data

US 2020/0271386 A1 Aug. 27, 2020

(51) Int. Cl.

| | |
|---|---|
| ***F28D 9/00*** | (2006.01) |
| ***F28F 27/02*** | (2006.01) |
| ***F28F 3/12*** | (2006.01) |
| ***F28F 9/013*** | (2006.01) |
| ***F28F 13/06*** | (2006.01) |
| ***F28F 9/00*** | (2006.01) |

(52) U.S. Cl.

CPC ..... *F28D 9/0062* (2013.01); *F28F 3/12* (2013.01); *F28F 9/0131* (2013.01); *F28F 27/02* (2013.01); *F28F 9/001* (2013.01); *F28F 13/06* (2013.01); *F28F 2250/10* (2013.01)

(58) Field of Classification Search

CPC ..... F28D 9/0062; F28D 2021/0092; F28D 7/1615; F28D 2001/0273; F28D 1/06; F28D 7/0058; F28D 7/163; F28F 27/02; F28F 3/12; F28F 9/0131; F28F 2250/10; F28F 1/00; F28F 7/00; F28F 9/001; F28F 9/005; F28F 9/0234; F28F 9/026; F28F 9/0265; F28F 9/0268; F28F 9/028; F28F 9/24; F28F 13/06; F28F 21/062; F28F 2230/00; F28F 2275/14; F28F 2275/143; F28F 2280/06

USPC ..... 165/145, 157

See application file for complete search history.

(56) References Cited

U.S. PATENT DOCUMENTS 141,133 A * 7/1873 Gee ..... F28F 9/262 165/144

709,006 A * 9/1902 Geurink ..... F24H 1/38 122/216

(Continued)

*Primary Examiner* — Jianying C Atkisson

*Assistant Examiner* — Jose O Class-Quinones

(57) ABSTRACT

A heat exchanger with a plurality of flow path assemblies disposed in a core body, a first and a second core surface of the core body provided with a plurality of throughholes. Each throughhole on the first and the second core surface mated individually with a flow path assembly seat, a coupling means providing independent positioning as well as longitudinal axial orientation means to each of the flow path assembly disposed in the core body, wherein each flow path assembly seat provided on the first core surface engages a first tubular section of a corresponding flow path assembly, while each flow path assembly seat provided on the second core surface engages a second tubular section of a corresponding flow path assembly. Each flow path assembly provided with at least one chamber section, each chamber section having a medium directing component disposed within for a desired medium flow effect.

12 Claims, 9 Drawing Sheets

(56) References Cited

U.S. PATENT DOCUMENTS 838,966 A * 12/1906 Drew ..... F28F 9/0246 165/178
1,327,165 A * 1/1920 Merritt ..... F28F 3/086 165/148
1,336,225 A * 4/1920 Hardie ..... F24F 6/04 237/78 R
1,656,790 A * 1/1928 Heijkenskjold ..... F28D 11/02 165/90
2,016,341 A * 10/1935 Nelson ..... F28D 3/04 165/157
2,274,965 A * 3/1942 Kitto ..... F25B 15/00 62/493
2,752,127 A * 6/1956 Campel ..... F28F 21/02 165/145
3,099,315 A * 7/1963 Loehr ..... F28F 1/08 165/144
3,524,498 A * 8/1970 Galer ..... F28D 7/1638 165/104.25
4,739,828 A * 4/1988 Bayer ..... F28F 9/02 165/173
4,979,560 A * 12/1990 Dierbeck ..... F28F 13/12 165/173
4,981,170 A * 1/1991 Dierbeck ..... F28F 13/12 165/109.1
5,038,470 A * 8/1991 Dierbeck ..... F28F 13/12 29/890.03
5,042,572 A * 8/1991 Dierbeck ..... F28F 13/12 165/76
5,505,252 A * 4/1996 Mano ..... F24H 3/065 165/109.1
5,787,973 A * 8/1998 Kado ..... F28F 9/182 165/153
6,016,799 A * 1/2000 McNamara ..... A47J 37/1247 165/104.19
7,987,900 B2 * 8/2011 Nitta ..... F28F 13/08 165/109.1
8,307,886 B2 * 11/2012 Nitta ..... F28F 13/08 165/109.1
8,393,385 B2 * 3/2013 Nitta ..... F28F 13/08 165/170
8,584,741 B2 * 11/2013 Nitta ..... F28F 13/08 165/109.1
9,151,547 B2 * 10/2015 Nitta ..... F28D 1/05316
2005/0098307 A1 * 5/2005 Goto ..... F28D 7/1653 165/146
2010/0139885 A1 * 6/2010 Hoffman ..... F28D 17/02 165/7
2010/0139902 A1 * 6/2010 Baylis ..... F28F 1/08 165/177
2011/0030936 A1 * 2/2011 Nitta ..... F28D 1/0325 165/173
2013/0098590 A1 * 4/2013 Nitta ..... F28D 1/05341 165/177
2014/0131022 A1 * 5/2014 Nitta ..... F28F 13/08 165/177
2017/0284343 A1 * 10/2017 Nitta ..... F28F 13/08
2018/0038651 A1 * 2/2018 Tonellato ..... F28D 1/0316

* cited by examiner

HEAT EXCHANGE APPARATUS HAVING A PLURALITY OF MODULAR FLOW PATH ASSEMBLIES, ENCASED IN A CORE BODY WITH A PLURALITY OF CORRESPONDING FLOW PATH ASSEMBLY SEATS, PROVIDING MEANS FOR INDEPENDENT POSITIONING AND AXIAL ALIGNMENT FOR A DESIRED EFFECT

A heat exchange apparatus having a plurality of modular flow path assemblies, encased in a core body with a plurality of corresponding flow path assembly seats, providing means for independent positioning and axial alignment for a desired effect.

BACKGROUND OF THE INVENTION

In a typical heat exchanger, a core body comprising of a plurality of tube sections is provided wherein at least two heat exchange mediums are utilized to facilitate heat exchange between the two heat exchange mediums. A first heat exchange medium is generally contained inside the plurality of tube sections while a second heat exchange medium flows outside the plurality of tube sections. The purpose of using a typical heat exchanger is to generally transfer heat from the first heat exchange medium to the second heat exchange medium. The heat can be transferred from inside the heat exchanger to the outside, or vice versa. With the desire to effectively utilize a limited amount of packaging space provided for a heat exchanger in an application, the heat exchanger may not be provided with an environment that optimizes heat transfer performance. Namely, when free flowing external heat exchange medium such as air is used as an external heat exchange medium, it is vital that the heat exchanger is provided with an optimal flow path for the external heat exchange medium, facilitating effective transfer of heat between the first and the second heat exchange medium. In an automotive application, for example, heat exchangers vital for proper operation of a vehicle are typically located at the very front of the vehicle, to facilitate means to provide the heat exchangers with as much flow of air as possible to achieve optimum heat transfer. The location at the front of the vehicle is desirable, as the location generally provides the heat exchangers with the optimum flow of the external heat exchange medium, which in the automotive radiator application may generally be air.

However, as the desire to design a smaller, more compact vehicle is pursued, the traditional space at the front of the vehicle may no longer be available for the purpose of locating heat exchangers. As such, need arises to position the heat exchangers at non-traditional positions, such as to a side of a vehicle engine compartment, on a side fender panel, or on a bonnet of a vehicle, for example. As the alternative heat exchanger locations typically do not provide for optimum external heat exchange medium flow, a solution must be devised to provide the heat exchanger with an optimum external heat exchange medium flow regardless of the positioning of the heat exchanger within the vehicle, which may include space or shape limitations, for example. Similar constraints impacting optimal heat transfer efficiency is not only limited in an automotive application, therefore, a solution provided herein may be applied to a variety of heat exchanger applications. Similar constraints may be observed in other applications of heat exchangers, such as in general electronics, appliances, and industrial cooling systems, for example. The present invention relates to optimization of the external heat exchange medium flow, wherein individual flow paths provided within the heat exchanger for the external heat exchange medium are optimized for positioning as well as horizontal and vertical axial orientation to enhance the overall heat exchange performance, while achieving the desired effect in a cost effective manner along with enhancements made to the heat conduction effectiveness, yielding higher heat transfer performance in a smaller heat exchanger package.

Discussion of the Related Art

A prior art heat exchanger, commonly called a tube and fin heat exchanger, is typically comprised of a plurality of tubular sections and fin sections stacked interchangeably together as an assembly to generally optimize ease of assembly. The tubular sections are used to transport the internal heat exchange medium as well as to transfer heat between the internal heat transfer medium and the external heat transfer medium. The fin sections are attached to the exterior surface of the tube sections to supplement the tubes in transferring heat between the internal heat exchange medium and the external heat exchange medium. The assembly comprising the tube sections and the fin sections, commonly referred to as a core, is designed primarily for minimizing assembly cost, in turn, generally not given any provisions for cost effective means for minute adjustments of individual tubular section and fin section orientation to optimally align the individual components to the expected flow pattern of the external heat exchange medium.

The core section of the prior art heat exchanger generally is designed for a simplified uniform flow of the external heat exchange medium, wherein the assumption is that the flow of the external heat exchange medium is uniform throughout the core surface, even though in actual application, it is typically not the case. Similarly, in some instances where space is restricted for positioning of a heat exchanger, the heat exchanger may be bent or contorted to fit in a space available in an application. For example, a radiator for a motorcycle is generally placed in front of an engine of the motorcycle. Due to the size restriction of the space generally available for the radiator, the radiator core is commonly provided with a tapered core shape that is generally concave convexo in appearance, when observed from the frontal plane of the radiator.

As the core is formed to fit in the required package space, the tube sections and fin sections provided within the core may no longer align in the most desirable way with the expected flow pattern of the external heat exchange medium, which may negatively affect the performance of the heat exchanger. Namely, when the flow path for the external heat exchange medium is not ideally aligned to the expected flow pattern of the external heat exchange medium, the external heat exchange medium may be required to make flow directional changes within the core of the heat exchanger, thereby hampering heat transfer effectiveness by increasing pressure drop effect to the external heat exchange medium, generally known in the art to adversely affect the performance of the heat exchanger. As the performance of the heat exchanger is negatively affected, the heat exchanger may need to be larger in physical size, which generally results in need for additional raw material, which in turn results in additional weight and cost as well as requiring additional packaging space for the heat exchanger placement.

Generally, in a prior art heat exchanger, a first lateral side of the core is terminated with a first header plate while a second lateral side of the core is terminated with a second header plate. The first and the second header plates are laterally space apart, positioned generally parallel to each other. Coupled between the first and the second header plates are a plurality of tubes and fin structures, positioned transversely in relation to the pair of header plates. First leading longitudinal edge of the plurality of tubes and fin structures form a frontal plane of the core, generally facing the flow of the external heat exchange medium, wherein space provided between the plurality of tubes and fins act as an inlet for the external heat exchange medium of the heat exchanger. Second trailing longitudinal edge of the plurality of tubes and fin structures form a backward facing plane of the core, wherein space provided between the plurality of tubes and fins act as an outlet for the external heat exchange medium to facilitate discharge of the external heat exchange medium out of the heat exchanger.

In a prior art heat exchanger, as the first lateral end of the plurality of tubes are affixed to the first header plate while the second lateral end of the plurality of tubes are affixed to the second header plate, when a heat exchanger application calls for the heat exchanger core surface to be formed or contorted in shape to fit within a given package space, the external heat exchange medium flow paths provided within the core generally obtains similarly contorted flow path arrangement. Therefore, the flow path provided for the external heat exchange medium within the heat exchanger core may no longer align with the expected flow path of the external heat exchange medium, negatively affecting the heat transfer effectiveness of the heat exchanger as a result. As the orientation of the individual tubes and fins are dictated by the corresponding mating holes for the tubes provided on the first and the second header plates, the only adjustment available for the tubes and fins are vertical angulation at best. As a result, it is difficult if not impossible to align individual flow paths provided within the core for the external heat exchange medium in a desired way to optimize external heat exchange medium flow to maintain heat transfer effectiveness in a cost-effective manner.

In an embodiment of the present invention, the flow paths for the external heat exchange medium within a core body are provided by a plurality of flow path assemblies, which are independent, modular, and self-contained units permitting means to independently align the individual flow path assemblies, in an easy, cost effective manner within the core body of the heat exchanger. The internal heat exchange medium for the heat exchanger flow within the core body, contained within a vessel comprised of a plurality of core body panels, which can be easily separately designed without adversely affecting the locating means or axial orientation of the plurality of flow path assemblies, thereby permitting means to obtain desirable heat transfer performance for any given application of the heat exchanger. A frontal plane of the heat exchanger core body is established by a first core surface while a backward facing plane of the heat exchanger core body is established by a second core surface. The positioning and axial orientation of the individual flow path assemblies within the core body are accomplished by the corresponding individual flow path assembly seats provided on the first core surface and individual flow path assembly seats provided on the second core surface, which together provides for means to independently align and locate within the core body the individual flow path assemblies, regardless of the general planar characteristics established by the first core surface and the second core surface. Such feature allows for heat exchanger design maximizing flow of the external heat exchange medium into the core body of the heat exchanger, minimizing pressure drop effect to the external heat exchange medium flow, vastly improving heat transfer effectiveness as a result. Furthermore, as individual flow path assemblies are modular units, flow path assemblies of various configurations may be coupled within the core body for a desired effect in a cost-effective manner. Improved performance as a result permits designing smaller heat exchanger of equal or higher heat transfer performance compared to a conventional heat exchanger, permitting means for significant cost savings in usage of raw materials and assembly cost, which by extension permits designing heat exchanger of lighter weight, generally a desirable feature in many heat exchanger applications.

SUMMARY OF THE INVENTION

In an embodiment of the present invention, a heat exchanger is provided with a core body. Exterior structure of the core body is a fluid containing vessel, comprising of at least one component, having a first core surface having a thickness, a second core surface having a thickness set at a predetermined longitudinal spacing away from the first core surface, a first lateral core wall having a thickness sealingly mating the first lateral side edge respectively of the first core surface and the second core surface, a second lateral core wall having a thickness sealingly mating the second lateral side edge respectively of the first core surface and the second core surface, a top core wall having a thickness longitudinally sealingly mating the top vertical edge respectively of the first core surface and the second core surface while laterally sealingly mating the top vertical edge respectively of the first lateral core wall and the second lateral core wall, and a bottom core wall having a thickness longitudinally sealingly mating the bottom vertical edge respectively of the first core surface and the second core surface, while laterally sealingly mating the bottom vertical edge respectively of the first lateral core wall and the second lateral core wall.

Coupled within the fluid containing vessel comprising the first and second core surface, the first and second lateral core wall, and the top and bottom core wall are a plurality of flow path assemblies completing the core body. A first heat exchange medium flow within the fluid containing vessel, while flowing externally of the plurality of flow path assemblies coupled within the core body. A second heat exchange medium flow within the plurality of flow path assemblies coupled within the core body, facilitating heat transfer between the first heat exchange medium and the second heat exchange medium by conduction generally through the material comprising the plurality of flow path assemblies.

The top core wall may be provided with at least one inlet to introduce the first heat exchange medium into the heat exchanger. The bottom core wall may be provided with at least one outlet to discharge the first heat exchange medium out of the heat exchanger. In an embodiment of the present invention, the top core wall may be sealingly coupled to an inlet tank. In another embodiment of the present invention, the bottom core wall may be sealingly coupled to an outlet tank. In yet another embodiment of the present invention, the top core wall and the bottom core wall may both be individually coupled to a respective tank.

The core body is provided with the first core surface having a plurality of throughholes, which are orifices extending the thickness of the first core surface. The first core surface may be rectangular, square or any other geometric shape, such as trapezoidal shape, for example. The first side of the first core surface may be of generally flat planar surface, or it may have a contour to give the surface a convex or a concave shape. In yet another embodiment of the present invention, the first side of the first core surface may feature a right angle, providing the first core surface with more than one distinct planar surfaces. Furthermore, the contour provided on the first side of the first core surface may be of a singular moderate radius, a combination of a plurality of moderate radii, one or more of an obtuse or an acute angle, or a combination of one or more radii and angles. The opposite side of the first side of the first core surface is a second side of the first core surface. On the second side of the first core surface, the plurality of throughholes provided on the first core surface are individually mated with a flow path assembly seat surrounding the individual throughholes for the purpose of coupling a first longitudinal end of the plurality of individual flow path assemblies to the first core surface. The flow path assembly seat surfaces provided on the first core surface may be set at a parallel angle relative to the plane established by the respective second side of the first core surface in the immediate vicinity surrounding the individual flow path assembly seat surfaces, or in other embodiment of the present invention, the flow path assembly seat surfaces may not be parallel to the plane established by the respective second side of the first core surface in the immediate vicinity surrounding the flow path assembly seat surfaces.

Longitudinally spaced apart from the second side of the first core surface is the second core surface, wherein a first side of the second core surface faces the second side of the first core surface. In an embodiment of the present invention, the contour of the first side of the second core surface may generally mirror the shape of the second side of the first core surface. In other embodiment of the present invention, however, the first side of the second core surface may not mirror the contour of the second side of the first core surface. The second core surface is provided with a plurality of throughholes, which are orifices extending the thickness of the second core surface. The quantity of throughholes provided on the second core surface generally correspond to the quantity of throughholes provided on the first core surface.

The plurality of throughholes provided on the second core surface are individually mated with the flow path assembly seat surface surrounding the individual throughholes for the purpose of individually coupling a second longitudinal end of the plurality of individual flow path assemblies to the second core surface. The flow path assembly seat surfaces on the second core surface may be parallel relative to the plane established by the first side of the second core surface in the immediate vicinity surrounding the individual flow path assembly seat surface, or in other embodiments of the present invention may not be parallel to the plane established by the respective first side of the second core surface in the immediate vicinity surrounding the flow path assembly seat surface.

In an embodiment of the present invention, the second heat exchange medium is introduced into the heat exchanger through the plurality of throughholes provided on the first core surface, travel through the plurality of flow path assemblies provided in the core body, then discharged out of the plurality of throughholes provided on the second core surface.

The flow path assembly seats on the first core surface and the second core surface provide for means for independent adjustment of the horizontal and the vertical axial orientation of the individual flow path assemblies, regardless of the plane established by the first and the second core surface. The flow path assembly seats further provide locating means of the individual flow path assemblies within the core body.

In an embodiment of the present invention, flow path assembly seats populated on the second side of the first core surface may set flush with the plane established by the second side of the first core surface. In other embodiments of the present invention, a first longitudinal end of the flow path assembly seats may be set at a plane that is outwardly extending from the plane established by the first side of the first core surface, or yet in another embodiment a second longitudinal end of the flow path assembly seats may be set inward from the plane established by the second side of the first core surface. Similarly, flow path assembly seats populated on the first side of the second core surface may set flush with the plane established by the first side of the second core surface. In other embodiments of the present invention, a first longitudinal end of the flow path assembly seats populated on the first side of the second core surface may be set at a plane that is inward from the plane established by the first side of the second core surface or the second longitudinal end of the flow path assembly seats may extend outward from the plane established by a second side of the second core surface.

The second heat exchange medium introduced into the plurality flow path assemblies encounter a plurality of obstacles that force fluid flow directional changes that disrupt heat transfer boundary layer formation, which in turn improves heat transfer effectiveness of the heat exchange medium. In a preferred embodiment of the present invention, the flow paths provided are void of secondary surface features, such as an offset fin or other structures known in the art. However, in other embodiment of the present invention, secondary surface features know in the art may be populated within or outside of the flow path assembly.

In an embodiment of the present invention, a first longitudinal end of the plurality of flow path assemblies are individually provided with the first tubular section. The first tubular section is a hollow member, permitting flow of the second heat exchange medium therethrough, while providing coupling means for the plurality of flow path assemblies to a corresponding first panel flow path assembly seats provided on the first core surface. In an embodiment of the present invention, the diameter of the first tubular section may be smaller than the diameter of the chamber section. In other embodiment of the present invention, the diameter of the first tubular section may generally be the same as the diameter of the chamber section. A second longitudinal end of the plurality of flow path assemblies are individually provided with the second tubular section. The second tubular section is a hollow member, permitting flow of the second heat exchange medium therethrough, while also providing coupling means for the plurality of flow path assemblies to the plurality of corresponding second panel flow path assembly seats provided on the second core surface. In an embodiment of the present invention, the diameter of the second tubular section may be shown smaller than the diameter of the chamber section. In yet another embodiment of the present invention, the diameter of the second tubular section may generally be the same as the diameter of the chamber section. In an embodiment of the present invention, the first tubular section is coupled to a first longitudinal end of the chamber section while the second tubular section is coupled to a second longitudinal end of the chamber section.

Longitudinally disposed between the first tubular section and the second tubular section is the chamber section. The chamber section is a hollow member, permitting flow of the second heat exchange medium therethrough. The first tubular section, the chamber section, and the second tubular section are fluidly connected to each other, permitting flow of the second heat exchange medium between respective components comprising the flow path assembly.

Disposed within the chamber section is the medium directing component. The medium directing component generally functions to longitudinally partition the heat exchange medium flow space provided within the chamber section into two distinct longitudinal zones, an anterior chamber section longitudinally spaced between the first core surface and the medium directing component and a posterior chamber section longitudinally spaced between the medium directing component and a medium directing component base, a planar member, which in an embodiment of the present invention, may be provided as part of the posterior chamber wall of the chamber section. In another embodiment of the present invention, the posterior chamber section may be longitudinally spaced between the medium directing component and a seat interior base, a planar panel member, coupled to the second core surface to maximize the flow space available for the second heat exchange medium to further mix and agitate within the flow path assembly to enhance overall heat transfer efficiency.

The medium directing component, having an inlet medium directing panel, a generally planar member facing towards the first core panel throughholes, further functions to disperse as well as divert the flow of the second heat exchange medium collected in the anterior chamber section. The inlet medium directing panel having a planar surface set at an inclined angle relative to the longitudinal axial orientation of the chamber section induces great amount of swirling and mixing effect to the second heat exchange medium within the chamber section as the second heat exchange medium is directed towards the inlet medium directing panel, while the inclined face of the inlet medium directing panel functions to simultaneously divert the flow of the second heat exchange medium in a generally vertical direction, generally following the slope of the angled face of the inlet medium directing panel. The inlet medium directing panel is generally free of any heat exchange medium flow restricting obstructions on its lateral edges that may restrict the amount of swirling and mixing effect occurring to the second heat exchange medium within the chamber section. Minimizing presence of obstruction on the inlet medium directing panel further lends itself to reduce potential pressure drop effect to the flow of the second heat exchange medium, which may be detrimental to the heat transfer performance, while maintaining the beneficial effect of swirling and mixing effect to the second heat exchange medium.

After the second heat exchange medium is directed into the vertical direction of flow within the interior of the chamber section by the inlet medium directing panel, the second heat exchange medium is further diverted into two divergent flow patterns within the chamber section in a semi-circular manner, generally symmetrical to one another. The two semi-circular flow patterns generally flow away from each other, while generally vertically axially aligned to one another, following the contour of the interior of the chamber section within the posterior chamber section, the respective flows longitudinally located between the medium directing component and the medium directing component base. In another embodiment of the present invention, the two semi-circular flow of the second heat exchange medium may be located between the medium directing component and the seat interior base coupled to the second core surface, located at the terminal edge of a second longitudinal end of the second tubular section, thereby maximizing the interior space available within the flow path assembly to facilitate further swirling and mixing effect to the second heat exchange medium, enhancing the overall heat transfer performance of the heat exchanger. In an embodiment of the present invention, the seat interior base may be an independent component coupled to the medium directing component or to the second core surface. In other embodiment of the present invention, the seat interior base may be provided as an integral component of the second core surface or the medium directing component.

The configuration of the interior contour of the chamber section along with a first lateral directing panel, a top directing panel, and a second lateral directing panel coupled to the medium directing component channels the flow of the two semi-circular flow of the second heat exchange medium originated on the anterior section of the chamber section towards an outlet medium directing panel. The outlet medium directing panel is an inclined planar surface provided on the medium directing component, generally on the opposite side of the inlet medium directing panel. The outlet medium directing panel is partially laterally abutted by the first lateral directing panel and the second lateral directing panel while a top vertical end of the outlet medium directing panel is terminated with the top directing panel, obstructing the second heat exchange medium introduced towards the outlet medium directing panel located within the posterior section of the chamber section from flowing back towards the anterior section of the chamber section, located forward of the medium directing component. Minimizing flow back of the second heat exchange medium prevents pressure drop effect to the second heat exchange medium, thereby enhancing the heat transfer effectiveness of the heat exchanger by extension.

Furthermore, when the second heat exchange medium is directed towards the outlet medium directing panel, the medium directing component having the first lateral directing panel, the second lateral directing panel and the top directing panel acting as a barrier, generally merge the two semi-circular flow of the second heat exchange medium into a singular flow, while simultaneously directing the flow of the second heat exchange medium in a new longitudinal flow direction, wherein the angle of attack of the new flow direction is substantially divergent from the respective lines of flow of each semi-circular flow paths. The outlet medium directing panel of the medium directing member has an inclined surface, generally diverting the flow of the second heat exchange medium to nearly a perpendicular flow pattern in relation to the two semi-circular flow paths, now generally axially aligned to the longitudinal axial orientation of the chamber section, where the flow of the second heat exchange medium is further directed towards the throughholes provided on the second core surface.

In an embodiment of the present invention, a first longitudinal end respectively of the first lateral directing panel, the second lateral directing panel, and the top vertical directing panel are coupled to the outlet medium directing panel, while a second longitudinal end respectively of the first lateral directing panel, the second lateral directing panel, and the top vertical directing panel are coupled to the seat interior base. In other embodiment of the present invention, the second longitudinal end of the respective components may be coupled to the medium directing component base. The configuration comprising of the outlet medium directing panel, the first lateral directing panel, the second lateral directing panel, and the top vertical directing panel acts as a channel for the second heat exchange medium, fully directing the flow of the second heat exchange medium towards the throughholes provided on the second core surface, enhancing the heat transfer effectiveness by minimizing pressure drop effect to the second heat exchange medium. The arrangement also generally prevents the second heat exchange medium to flow directly from the anterior section of the chamber section to the throughholes provided on the second core surface, thereby enhancing the performance of the heat exchanger by forcing the second heat exchange medium to flow through the stirring and mixing effect afforded by the medium directing component feature placed in the posterior section of the chamber section.

The flow path assembly may comprise the first tubular section, the chamber section, the second tubular section, and the medium directing component disposed within the chamber section. In other embodiment of the present invention, a plurality of flow path assemblies as described herein may be coupled together in a serial manner. As such, the flow pattern described herein may be repeated dependent upon the number of the first tubular sections, the chamber sections, the second tubular section, and medium directing component packaged within an embodiment of the flow path assembly coupled within an embodiment of the heat exchanger.

In an embodiment of the present invention, various components comprising the heat exchanger may be produced of ferrous or non-ferrous material. Similarly, the components may be made of plastics or composite materials. The components may be produced of the same material or may be produced of dissimilar materials. Various coupling means may be utilized, which may include but not limited to adhesives, epoxy, mechanical means, or brazing and soldering, for example. In another embodiment of the present invention, various components may be welded without additional bonding material, such as in the case of laser welding. In yet another embodiment of the present invention, a portion or all of the components may be manufactured by means of 3D printing technology, known in the art.

Other features and advantages of the present invention will be readily appreciated, as the same becomes better understood after reading the subsequent description taken in conjunction with the accompanying drawings.

BRIEF DESCRIPTIONS OF THE DRAWINGS

DETAILED DESCRIPTION

Figure 1:
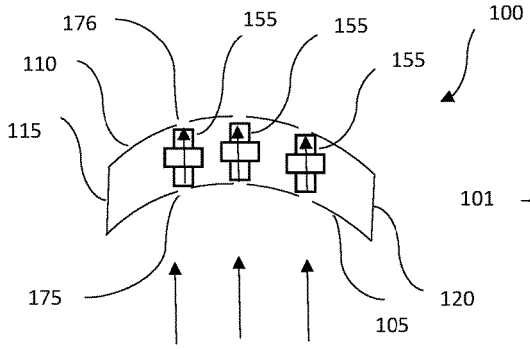
FIG. 1 is a schematic top view of a heat exchanger according to an embodiment of the present invention, shown by arrows the expected flow pattern of the external heat exchange medium.
Figure 2:
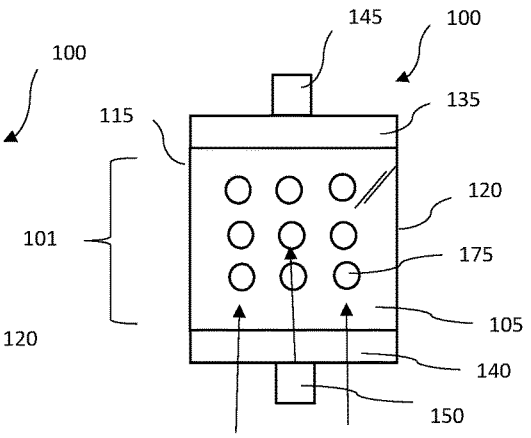
FIG. 2 is a schematic frontal view of a heat exchanger according to an embodiment of the present invention, shown by arrows the expected flow pattern of the external heat exchange medium.
Figure 3:
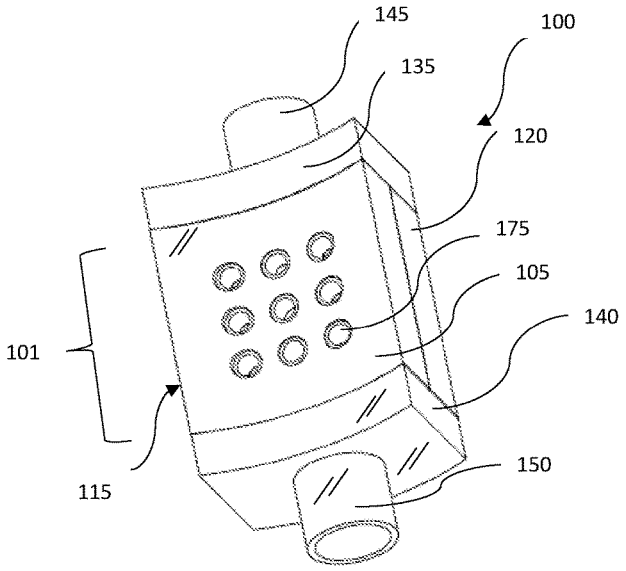
FIG. 3 is a perspective view of a heat exchanger according to an embodiment of the present invention.

Referring to the drawings and in particular FIGS. 2 and 3, an embodiment of a heat exchanger 100 is shown. The heat exchanger 100 is provided with a core body 101, a fluid containing vessel. The core body 101 exterior body comprises of at least one component, having a first core surface 105 having a material thickness establishing a frontal plane of the core body 101, a second core surface 110 (Now referencing FIG. 1) having a material thickness set at a predetermined longitudinal spacing away from the first core surface 105 establishing a backward plane of the core body 101, a first lateral core wall 115 having a material thickness sealingly mating a first lateral side edge respectively of the first core surface 105 and the second core surface 110 establishing a first lateral plane of the core body 101, a second lateral core wall 120 having a material thickness sealingly mating a second lateral side edge respectively of the first core surface 105 and the second core surface 110 establishing a second lateral plane of core body 101, a top core wall 125 having a material thickness (Now referencing FIG. 4) longitudinally sealingly mating a top vertical edge respectively of the first core surface 105 and the second core surface 110 while laterally sealingly mating a top vertical edge respectively of the first lateral core wall 115 and the second lateral core wall 120, establishing a top vertical plane of the core body 101, and a bottom core wall 130 having a material thickness longitudinally sealingly mating a bottom vertical edge respectively of the first core surface 105 and the second core surface 110 while laterally sealingly mating a bottom vertical edge respectively of the first lateral core wall 115 and the second lateral core wall 120, establishing a bottom vertical plane of the core body 101.

In an embodiment of the present invention, the first core surface 105, the second core surface 110, the first lateral core wall 115, and second latera core wall 120 may be shown generally as rectangular in shape. However, in other embodiments of the present invention, respective components may be in other geometric shape such as a square or trapezoidal shape, for example.

Coupled within the fluid containing vessel comprising the first core surface 105, the second core surface 110, the first lateral core wall 115, the second lateral core wall 120, the top core wall 125, and the bottom core wall 130 are a plurality of flow path assemblies 155, completing the core body 101. In an embodiment of the present invention, a first heat exchange medium flow internally within the fluid containing vessel established by the core body 101 exterior body, while flowing externally of the plurality of flow path assemblies 155 coupled within the core body 101. A second heat exchange medium flow within the plurality of flow path assemblies 155 coupled within the core body 101, facilitating heat transfer between the first heat exchange medium and the second heat exchange medium by conduction generally through the material comprising the plurality of flow path assemblies 155 coupled within the core body 101.

Figure 4:
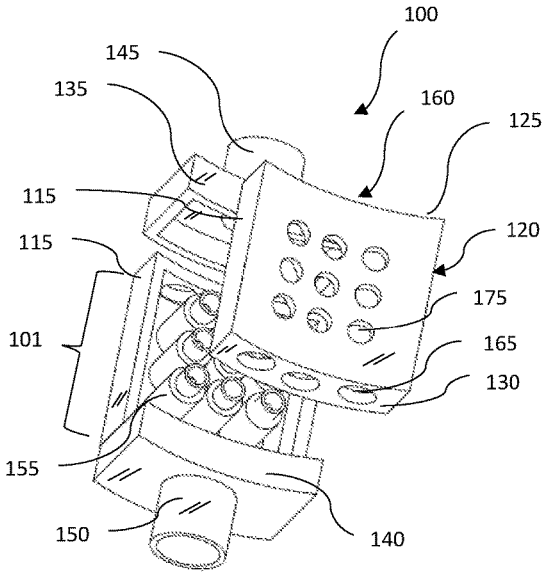
FIG. 4 is an exploded perspective view of a heat exchanger according to an embodiment of the present invention.
Figure 9:
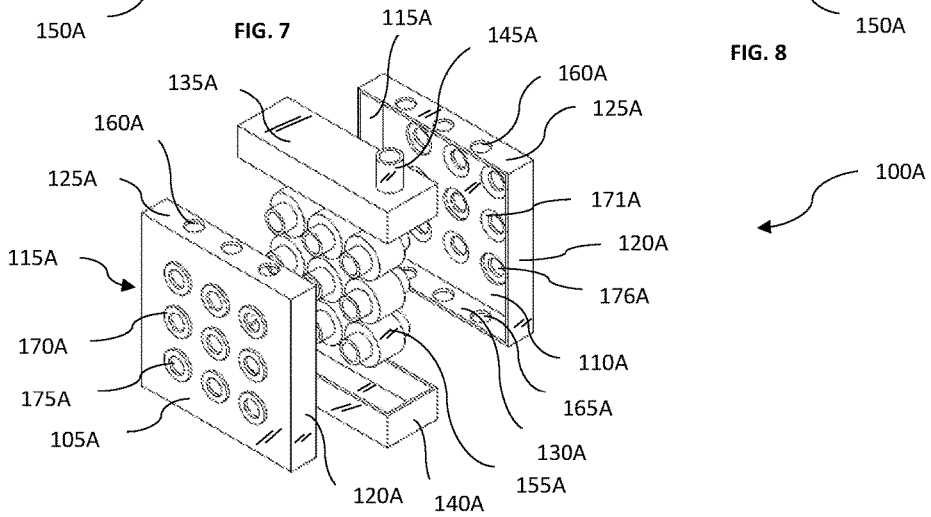
FIG. 9 is a perspective exploded view of the heat exchanger shown in FIG. 5.

Now referring to FIGS. 4 and 9, the top core wall 125 may be provided with at least a core inlet 160, an orifice extending the thickness of the top core wall 125, to introduce the first heat exchange medium into the heat exchanger 100. The bottom core wall 130 may be provided with at least a core outlet 165, an orifice extending the thickness of the bottom core wall 130, to discharge the first heat exchange medium out of the heat exchanger 100. Now referencing FIGS. 4 and 9, the top core wall 125 may be sealingly coupled to an inlet tank 135, utilize to collect the first heat exchange medium within the heat exchanger 100 as well as to distribute the first heat exchange medium within the core body 101 for a desired effect. In another embodiment of the present invention, the bottom core wall 130 may be sealingly coupled to an outlet tank 140, utilized to collect the first heat exchange medium as well as discharge the first heat exchange medium out of the core body 101 in a desired effect.

In yet another embodiment of the present invention, the heat exchanger 100 may have both the inlet tank 135 and the outlet tank 140 coupled to the core body 101 for a desired effect. In an embodiment of the present invention, the inlet tank 135 may be mated to an inlet pipe 145, a tubular member, in fluid communication with the interior of the inlet tank 135 to facilitate introduction of the first heat exchange medium into the inlet tank 135. In a similar fashion, the outlet tank 140 may be mated to an outlet pipe 150, a tubular member, in fluid communication with the interior of the outlet tank 140 to facilitate discharge of the first heat exchange medium out of the outlet tank 140.

Figure 5:
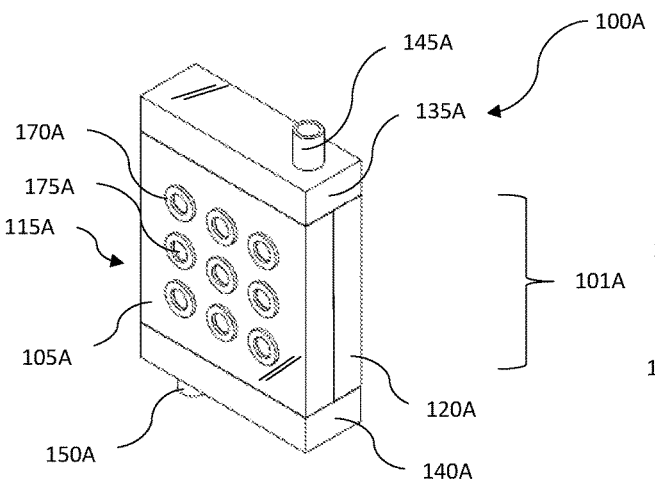
FIG. 5 is a perspective view of a heat exchanger according to another embodiment of the present invention.

Referring to FIG. 5, the inlet tank 135 as well as the outlet tank 140 may be coupled to the respective vertical end of the core body 101 end to end. In other embodiment of the present invention, now referencing FIG. 6, the inlet tank 135 may be provided with a first tank core lip 180, a protruded ridge member running along the bottom vertical end of the inlet tank 135 that engagingly couples to the exterior surface of the core body 101, to provide additional rigid coupling means to the inlet tank 135 to couple the inlet tank 135 to the core body 101. In a similar fashion, the outlet tank 140 may be provided with a second tank core lip 181, a protruded ridge member running along the top vertical end of the outlet tank 140 that engagingly couples to the exterior surface of the core body 101, to provide additional rigid coupling means to the outlet tank 140 to couple the outlet tank 140 to the core body 101.

In an embodiment of the present invention, the first heat exchange medium may be provided by a reservoir or by means of a cooling loop or a heat source to supply the first heat exchange medium into the heat exchanger 100. In yet another embodiment of the present invention, the heat exchanger 100 may be coupled with the inlet tank 135 and the outlet tank 140 to facilitate supply and discharge means of the first heat exchange medium to the heat exchanger 100. In such an embodiment of the present invention, the inlet tank 135 may be coupled to the reservoir or coupled to the cooling loop or the heat source to supply the inlet tank 135 with the first heat exchange medium, while the outlet tank 140 may be coupled to the reservoir or coupled to the cooling loop or the heat source to discharge the first heat exchange medium out of the outlet tank 140. In an embodiment of the present invention, the second heat exchange medium may be air, directed to the heat exchanger from atmosphere, for example.

Figure 6:
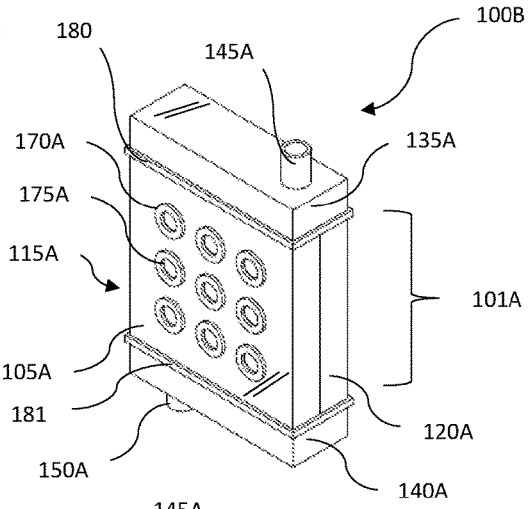
FIG. 6 is a perspective view of a heat exchanger according to yet another embodiment of the present invention.
Figure 7:
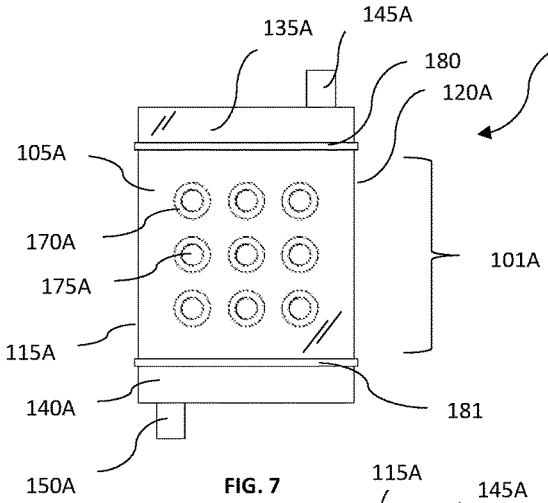
FIG. 7 is a frontal view of the heat exchanger shown in FIG. 6.
Figure 8:
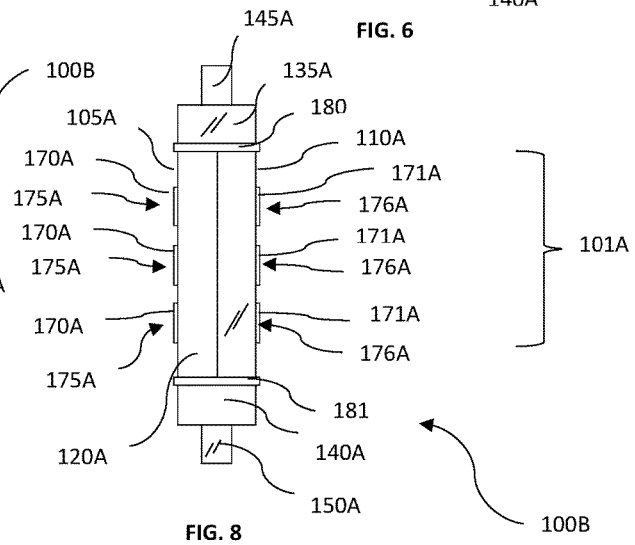
FIG. 8 is a side view of the heat exchanger shown in FIG. 6.

Now referring to FIGS. 1 and 3, the frontal plane of the core body 101 may be provided with the first core surface 105, a panel member having a thickness, having a plurality of first core panel throughholes 175, which are orifices extending the thickness of the first core surface 105. The first core surface 105 may be rectangular, square or any other geometric shape, such as trapezoidal shape, for example. Referring to FIGS. 5 and 6, the first side of the first core surface 105 may be of generally flat planar surface, or it may have a contour to give the surface a convex or a concave shape (See FIG. 3). In yet another embodiment of the present invention, the first side of the first core surface may feature a right angle, providing the first core surface with more than one distinct planar surfaces. Furthermore, the contour provided on the first side of the first core surface may be of a singular moderate radius, a combination of a plurality of moderate radii, one or more of an obtuse or an acute angle, or a combination of one or more radii and angles.

Figure 22:
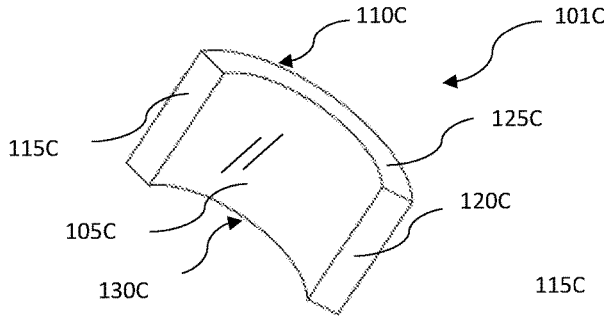
FIG. 22 is a perspective view of a heat exchanger core body according to an embodiment of the present invention.
Figure 23:
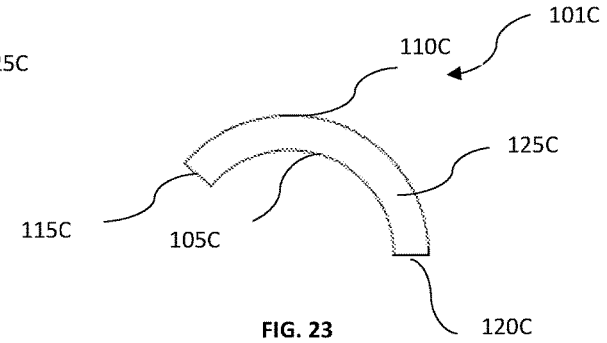
FIG. 23 is a top view of the heat exchanger shown in FIG. 22.

Referring now to FIGS. 22 and 23, in an embodiment of the present invention, a core body 101C when observed from a frontal plane forward of a first core surface 105C, may be provided with a concave face. In such an embodiment of the present invention, the core body 101C is provided with a frontal plane curvature with a radius that is curved inwards to create a concave shape. Such an embodiment of the core body 101C may be desirable when the lateral spacing provided for the heat exchanger 100 may be limited, wherein the curvature provides additional volumetric space within the core body 101C, whereby additional packaging space for the flow path assemblies 155 may be provided within the core body 101C, thereby providing additional heat conduction surface to the heat exchanger enhancing the overall heat transfer performance of the heat exchanger 100 within a package space that is laterally restricted.

As the curvature is provided to the first core surface 105C and a second core surface 110C, the flow path assemblies 155 provided within the core body 101C may no longer align with the expected flow pattern of the second heat exchange medium in a desirable manner. However, with the present invention, with the modular flow path assembly design along with flexible flow path assembly seat orientation means, the flow path assemblies 155 may be independently located and angulated horizontally as well as vertically to achieve a desired effect, maximizing the flow of the second heat exchange medium through the core body with minimal pressure drop effect. In such an embodiment of the present invention, the lateral planes of the core body 101C established by a first lateral core wall 115C and a second lateral core wall 120C may not be parallel to each other.

Furthermore, the first lateral core wall 115C and the second lateral core wall 120C may not be perpendicular to the surface established by the first core surface 105C, the second core surface 110C, or both the first core surface 105C and the second core surface 110C. Furthermore, a top core wall 125C may be coupled to a top vertical edge respectively of the first core surface 105C, the second core surface 110C, the first lateral core wall 115C, and the second lateral core wall 120C, while a bottom core wall 130C may be coupled to a bottom vertical edge respectively of the first core surface 105C, the second core surface 110C, the first lateral core wall 115C, and the second lateral core wall 120C. The top core wall 125C as well as the bottom core wall 130C may generally feature a concave convexo shape to sealingly couple to the first core surface 105C and the second surface 110C of the core body 101C. In yet another embodiment of the present (Not shown), the core body may be provided with a convex shape when observed from the frontal plane of the core body, giving the core body a convexo concave shape.

Figure 24:
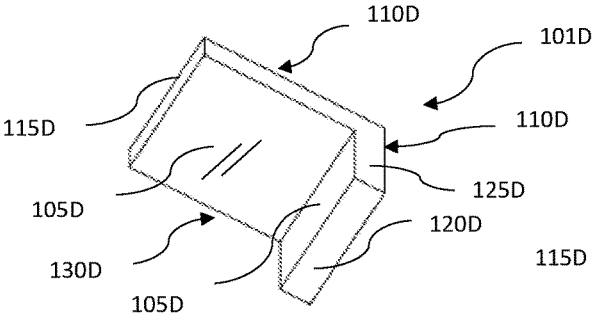
FIG. 24 is a perspective view of a heat exchanger core body according to another embodiment of the present invention.
Figure 25:
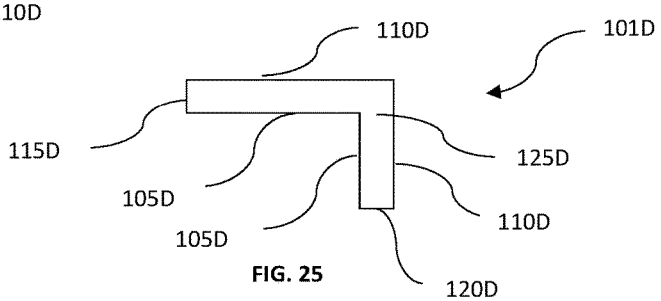
FIG. 25 is a top view of the heat exchanger shown in FIG. 24.

Now referring to FIGS. 24 and 25, in another embodiment of the present invention, a core body 101D when observed from a frontal plane forward of a first core surface 105D may be provided with two distinct planar surfaces. Similar to the core body 101C, such an embodiment may be desirable when the lateral spacing is limited while there is a need to maximize heat transfer effectiveness by populating as many flow path assemblies 155 as possible in the core body 101D. In this embodiment of the present invention, the first core surface 105D is provided with a portion of the first core surface 105D extending outwards at a right angle out of the first core surface 105D. By having a right angle in the first core surface 105D, the first core surface 105D may be provided with two distinct planar regions within the first core surface 105D.

The flow path assemblies 155 populated within a first region of the first core surface 105D may be arranged with a uniform angulation as well as spatial positioning for a desired effect, while the flow path assemblies populated within a second region of the first core surface 105D may be arranged with a uniform angulation as well as spatial positioning within the second region. In such an embodiment of the present invention, positioning and angulation arrangement of the flow path assemblies 155 utilized in the first region of the first core surface 105D may be different from the positioning and angulation arrangement of the flow path assemblies 155 utilized in the second region of the first core surface 105D. In an embodiment of the present invention, the respective planar surfaces provided within the first core surface 105D may be paired with a corresponding second core surface 110D which generally mirrors the shape of the first core surface 105D. A first lateral side of the core body 101D may be provided by a first lateral core wall 115D, while a second lateral side of the core body 101D may be provided by a second lateral core wall 120D. The planar surfaces established by the first lateral core wall 115D may be generally perpendicular to the planar surfaces established by the second lateral core wall 120D. In other embodiment of the present invention, the plurality of flow path assemblies 155 populated within a region may not be uniform in spatial positioning or axial orientation. In yet another embodiment of the present invention, the plurality of flow path assemblies 155 populated within a region may comprise of one or more configurations.

Figure 26:
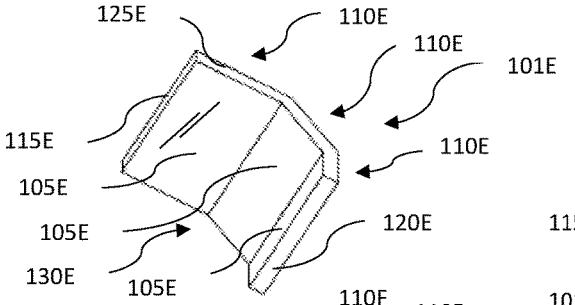
FIG. 26 is a perspective view of a heat exchanger core body according to yet another embodiment of the present invention.
Figure 27:
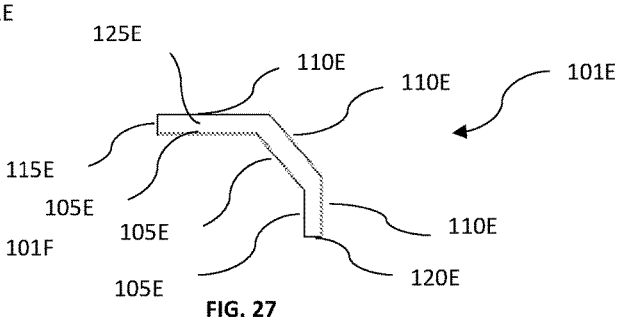
FIG. 27 is a top view of the heat exchanger shown in FIG. 26.

In an embodiment of the present invention, referring now to FIGS. 26 and 27, a core body 101E may be provided with a plurality of distinct planar surfaces arranged laterally in a serial manner, a plurality of distinct planar surfaces coupled at an obtuse angle next to each other, when observed from the frontal plane of the core body 101E. Such an embodiment of the heat exchanger 100 may be desirable when a lateral packaging space for a heat exchanger is restricted, similar to the feature observed with the embodiment of the core body 101C, while there is also a desire to provide the core body 101E with a plurality of regions, similar to the embodiment of the core body 101D. In an embodiment of the core body 101E shown, a first core surface 105E may be provided with three distinct planar surfaces, providing a plurality of regions within the core body 101E. In an embodiment of the core body 101E shown, three distinct planar regions are provided, while in other embodiments of the present invention, additional planar regions may be provided.

In an embodiment of the core body 101E, the flow path assemblies 155 populated within a first region may be arranged with a uniform angulation as well as spatial positioning for a desired effect, while the flow path assemblies populated within a second region may be arranged with a uniform angulation as well as spatial positioning within the second region differing from orientation and arrangement utilized in the first region. The flow path assemblies 155 populated within a third region may be arranged with a uniform angulation as well as spatial positioning for a desired effect, which may differ in orientation and arrangement from the first region as well as from the second region. In such an embodiment of the present invention, positioning and angulation arrangement of the flow path assemblies 155 utilized in the first region of the first core surface 105E, the second region of the first core surface 105E, and the third region of the first core surface 105E may be dissimilar from one another. In other embodiment of the present invention, the plurality of flow path assemblies 155 populated within a region may not be uniform in spatial positioning or axial orientation. In yet another embodiment of the present invention, the plurality of flow path assemblies 155 populated within a region may comprise of one or more configurations.

In an embodiment of the present invention, the respective planar surfaces provided within the first core surface 105E may be paired with a corresponding second core surface 110E which may generally mirror the shape of the first core surface 105E. In an embodiment of the present invention, positioning and angulation arrangement means of the plurality of flow path assemblies 155 within the first, the second, and the third regions of the first core surface 105E are accomplished by flow path assembly seats provided on the first core surface 105E as well as corresponding flow path assembly seats provided on the second core surface 110E.

A first lateral side of the core body 101E may be provided by a first lateral core wall 115E, while a second lateral side of the core body 101E may be provided by a second lateral core wall 120E. In an embodiment of the present invention, the planar surface established by the first lateral core wall 115E may be generally perpendicular to the planar surface established by the second lateral core wall 120E. A top core wall 125E may be coupled to a respective top vertical edge of the first core surface 105E, the second core surface 110E, the first lateral core wall 115E, and the second lateral core wall 120E, while a respective bottom vertical edge of the first core surface 105E, the second core surface 110E, the first lateral core wall 115E, and the second lateral core wall 120E may be coupled to a bottom core wall 130E, completing the core body 101E.

Figure 28:
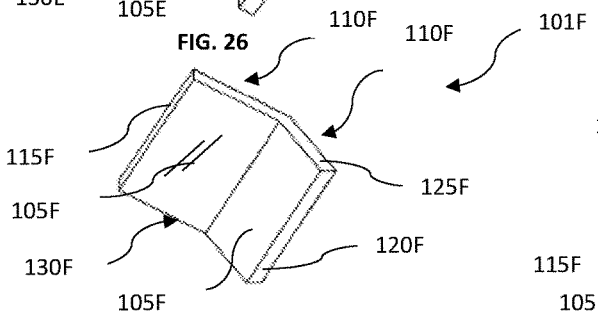
FIG. 28 is a perspective view of a heat exchanger core body according to another embodiment of the present invention.
Figure 29:
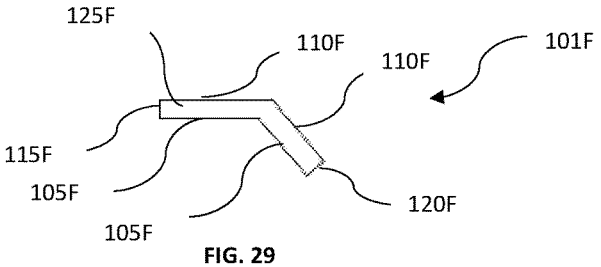
FIG. 29 is a top view of the heat exchanger shown in FIG. 28.

In yet another embodiment of the present invention, the core body may be provided with a singular obtuse angle provided on a first core surface 105F. Referring to FIGS. 28 and 29, a core body 101F when observed from the frontal plane forward of the first core surface 105F may be provided with two distinct planar surfaces. Similar to the core body 101C, such an embodiment may be desirable when the lateral spacing is limited while there is a need to maximize heat transfer effectiveness by populating as many of the flow path assemblies 155 as possible in the core body 101F. In this embodiment of the present invention, the first core surface 105F is provided with an obtuse angle extending a portion of the first core surface 105F outwards at an angle. By having an obtuse angle in the first core surface 105F, the first core surface 105F may be provided with two distinct planar regions within the first core surface 105F.

The flow path assemblies 155 populated within a first region may be arranged with a uniform angulation as well as spatial positioning for a desired effect, while the flow path assemblies 155 populated within a second region may be arranged with a uniform angulation as well as spatial positioning within the second region. In such an embodiment of the present invention, positioning and angulation arrangement of the flow path assemblies 155 utilized in the first region of the first core surface 105F and the second region of the first core surface 105F may be dissimilar from each other to obtain a desired effect. In an embodiment of the present invention, the respective planar surfaces provided within the first core surface 105F may be paired with a corresponding second core surface 110F which generally mirrors the shape of the first core surface 105F. In other embodiment of the present invention, the plurality of flow path assemblies 155 populated within a region may not be uniform in spatial positioning or axial orientation. In yet another embodiment of the present invention, the plurality of flow path assemblies 155 populated within a region may comprise of one or more configurations.

A first lateral side of the core body 101F may be provided by a first lateral core wall 115F, while a second lateral side of the core body 101F may be provided by a second lateral core wall 120F. The planar surfaces established by the first lateral core wall 115F may generally not be perpendicular nor parallel to the planar surface established by the second lateral core wall 120F. Top vertical edge respectively of the first core surface 105F, the second core surface 110F, the first lateral core wall 115F, and the second lateral core wall 120F may be engagingly coupled to a top core wall 125F, while bottom vertical edge respectively of the first core surface 105F, the second core surface 110F, the first lateral core wall 115F, and the second lateral core wall 120F may be engagingly coupled to a bottom core wall 130F, completing the core body 101F. In an embodiment of the present invention, desired positioning and axial angulation of the corresponding flow path assemblies 155 populated in the first region as well as the second region of the first core surface 105F are accomplished by the flow path assembly seats provided for the individual flow path assemblies on the first core surface 105F as well as by corresponding flow path assembly seats provided on the second core surface 110F.

Figure 18:
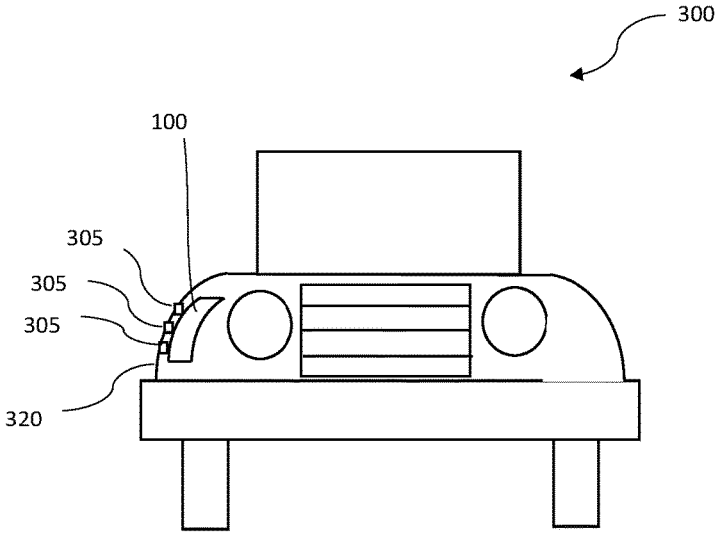
FIG. 18 is an illustrative frontal view of a vehicle showing a positioning of an embodiment of a heat exchanger according to the present invention to a side fender of the vehicle, also showing the contour of the heat exchanger fit to the shape of the vehicle fender panel, intake ventilation holes provided on the vehicle aligned with the positioning of the heat exchanger.
Figure 19:
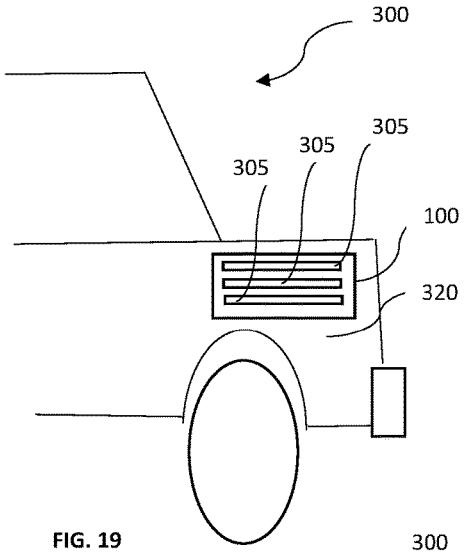
FIG. 19 is an illustrative side view of a vehicle showing a positioning of an embodiment of a heat exchanger according to the present invention to a side fender of the vehicle.

Reference is now made to FIGS. 18 and 19, where the heat exchanger 100 in an embodiment of the present invention is shown in an application. As the desire to design a smaller, more compact vehicle is pursued, for example, the traditional space at the front of the vehicle may no longer be available for the purpose of locating heat exchangers, which has historically been the location of choice to position heat exchangers critical for proper operation of vehicles. As a result, need arises to position the heat exchanger 100 at non-traditional positions, such as to a side of a vehicle engine compartment, on a side fender panel of a vehicle, or a bonnet of a vehicle, for example.

As the alternative heat exchanger locations typically do not provide for optimum external heat exchange medium flow, a solution must be devised to provide the heat exchanger with an optimum external heat exchange medium flow regardless of the positioning of the heat exchanger 100 within a vehicle 300, which may include space or shape limitations, for example. Similar constraints impacting optimal heat transfer efficiency is not only limited in an automotive application, therefore, a solution provided herein may be applied to a variety of heat exchanger applications. Similar constraints may be observed in other applications of heat exchangers, such as in general electronics, appliances, and industrial cooling systems, for example. Referring to FIG. 18, the heat exchanger 100 may be positioned to the side of the vehicle 300 on one of its side fenders 320. The first side of the heat exchanger 100 comprised of the first core surface 105 may be contoured to the shape of the fender 320, which may be arcuate in shape, minimizing the space needed to locate the heat exchanger 100 within the vehicle 300.

Furthermore, the modular flow path assemblies 155 provides for optimization of the external heat exchange medium flow, wherein individual external heat exchange medium flow paths provided within the heat exchanger 100 in the form of the first core panel throughholes 175 and a second core panel throughholes 176 may be optimally aligned in horizonal and vertical axial orientation with inlet orifices provided on the bonnet 320 in the form of a plurality of bonnet air intakes holes 325, whereby the external heat exchange medium flow are optimized for positioning and horizontal and vertical axial orientation to enhance the overall heat exchange performance. The individual flow path assemblies 155 coupled within the core body 101 are positioned as well as horizontally and vertically angled in a desired effect by a first panel flow path assembly seats 170 provided on the first core surface 105, along with a corresponding second panel flow path assembly seats 171 provided on the second core surface 110.

Figure 20:
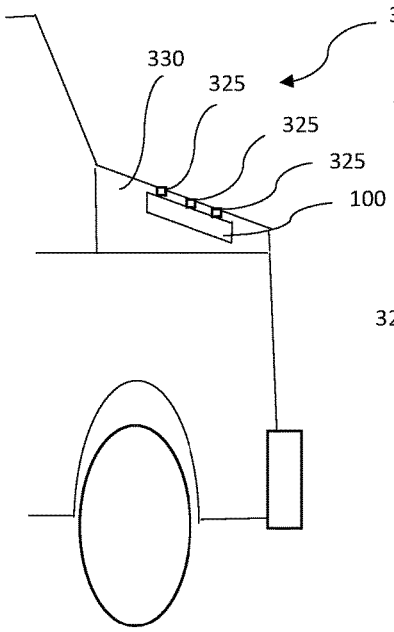
FIG. 20 is an illustrative side view of a vehicle showing a positioning of an embodiment of a heat exchanger according to the present invention to a bonnet of the vehicle.
Figure 21:
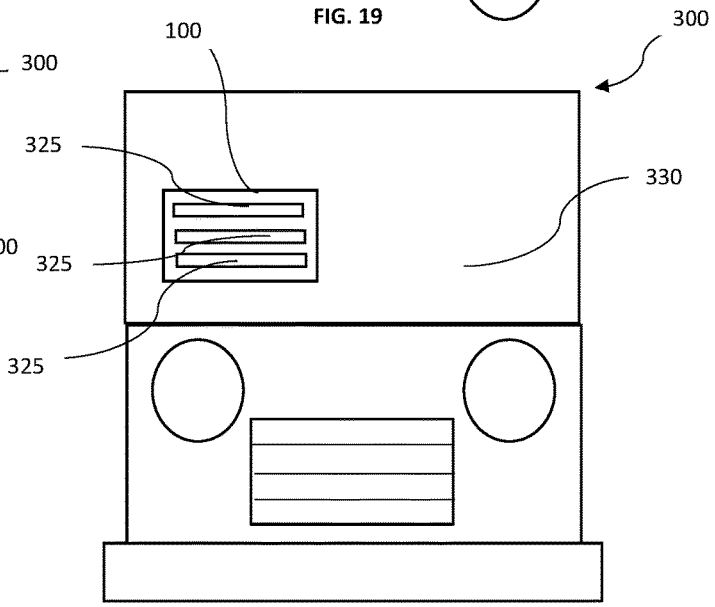
FIG. 21 is an illustrative top view of a vehicle showing the positioning of an embodiment of a heat exchanger according to the present invention to a bonnet of the vehicle.

Now referring to FIGS. 20 and 21, the heat exchanger 100 may be coupled to a bonnet 330 of the vehicle 300 to maximize non-traditional space for locating means of the heat exchanger 100. Generally, the bonnet 330, utilized for the vehicle 300 are not planar, and may also be provided with a plurality of distinct planar regions or radius or a plurality of radii, which may hamper locating a traditional heat exchanger in a space efficient manner. However, with the present invention, the core body 101 may be provided with a plurality of planar regions as well as a plurality of radii and angles to conform the core body 101 to the shape provided by the bonnet 330. As a result, the heat exchanger 100 may be coupled to the vehicle 300, all while efficiently utilizing limited space available within the vehicle 300 to locate the heat exchanger 100. Furthermore, flexible axial alignment and locating means of the flow path assemblies 155, allows the heat exchanger 100 to effectively utilize inlet holes provided for the second heat exchange medium on the bonnet 330 by means of the plurality of bonnet air intakes holes 325, wherein the flow path assemblies 155 and the bonnet air intakes holes 325 may be axially aligned as well as positionally located in proximity to each other to minimize pressure drop effect to the second heat exchange medium, thereby by extension enhancing the overall performance of the heat exchanger 100 in an application.

Referring to FIGS. 4 and 9, on the first side of the first core surface 105 facing the outside of the heat exchanger 100, the plurality of first core panel throughholes 175 are provided, which are orifices extending the thickness of the first core surface 105. On the second side of the first core surface 105, the first core panel throughholes 175 are individually mated with the second panel flow path assembly seat 171, which surrounds the individual first core panel throughholes 175 for the purpose of coupling the first longitudinal end of the plurality of individual flow path assemblies 155 to the first core surface 105. The first panel flow path assembly seats 170 populated on the first core surface 105 may be parallel relative to the plane established by the second side of the second core surface 105 in the immediate vicinity surrounding the first panel flow path assembly seat 170, or in other embodiments of the present invention may not be parallel to the plane established by the respective second side of the first core surface 105 in the immediate vicinity surrounding the individual first panel flow path assembly seat 170.

Referring again to FIGS. 4 and 9, longitudinally spaced apart from the second side of the first core surface 105 is the second core surface 110, wherein a first side of the second core surface 110 faces the second side of the first core surface 105. In an embodiment of the present invention, the contour of the first side of the second core surface 110 may generally mirror the shape of the second side of the first core surface 105. In other embodiment of the present invention, however, the first side of the second core surface 110 may not mirror the shape of the second side of the first core surface 105. The first side of the second core surface 110 is provided with the plurality of second core panel throughholes 176, which are orifices extending the thickness of the second core surface 110. The quantity of the second core panel throughholes 176 provided on the second core surface 110 generally correspond to the quantity of the first core panel throughholes 175 provided on the first core surface 105.

The plurality of second core panel throughholes 176 provided on the second core surface 110 are individually mated with the second panel flow path assembly seat 171 surrounding the individual throughholes 176 for the purpose of coupling a second longitudinal end of the plurality of individual flow path assemblies 155 to the second core surface 110. The second panel flow path assembly seats 171 populated on the second core surface 110 may be parallel relative to the plane established by the first side of the second core surface 110 in the immediate vicinity surrounding the individual second panel flow path assembly seat 171, or in other embodiments of the present invention may not be parallel to the plane established by the respective first side of the second core surface 110 in the immediate vicinity surrounding the individual second panel flow path assembly seat 171.

In an embodiment of the present invention, the second heat exchange medium is introduced into the heat exchanger 100 through the plurality of first core panel throughholes 175 provided on the first core surface 105, travel through the plurality of flow path assemblies 155 provided in the core body 101, then discharged out of the plurality of second core panel throughholes 176 provided on the second core surface 110. For each of the flow path assemblies 155 coupled within the core body 101, one first core panel throughhole 175 is individually assigned exclusively as an inlet means of the second heat exchange medium into the one particular flow path assembly 155. In a similar fashion, one second core panel throughhole 176 is individually assigned exclusively as an outlet means of the second heat exchange medium for the one particular flow path assembly 155.

The plurality of first panel flow path assembly seats 170 populated on the first core surface 105 and the plurality of second panel flow path assembly seats 171 populated on the second core surface 110 provide for means of independent horizontal and vertical axial orientation of the individual flow path assemblies 155, regardless of the plane established by the first core surface 105 and the second core surface 110. The first panel flow path assembly seats 170 and the second panel flow path assembly seats 171 further provide locating means of the individual flow path assemblies 155 within the core body 101.

Figure 10:
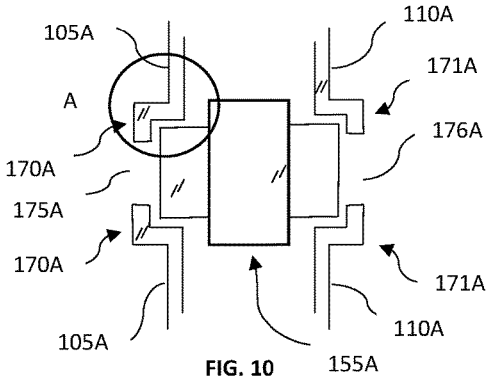
FIG. 10 is a side view showing a flow path assembly coupled within a respective flow path assembly seats provided on a first core surface and a second core surface according to an embodiment of the present invention.
Figure 33:
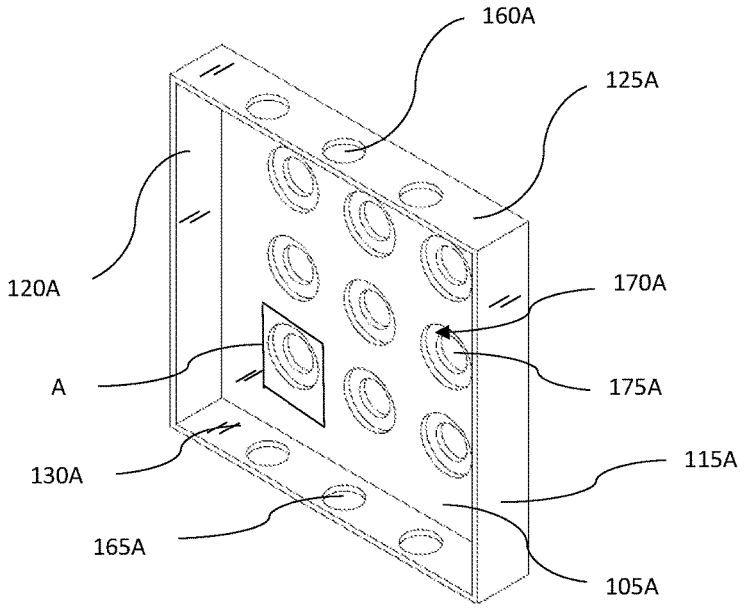
FIG. 33 is a back view of a first core surface, showing a second side of the first core surface, according to an embodiment of the present invention.
Figure 34:
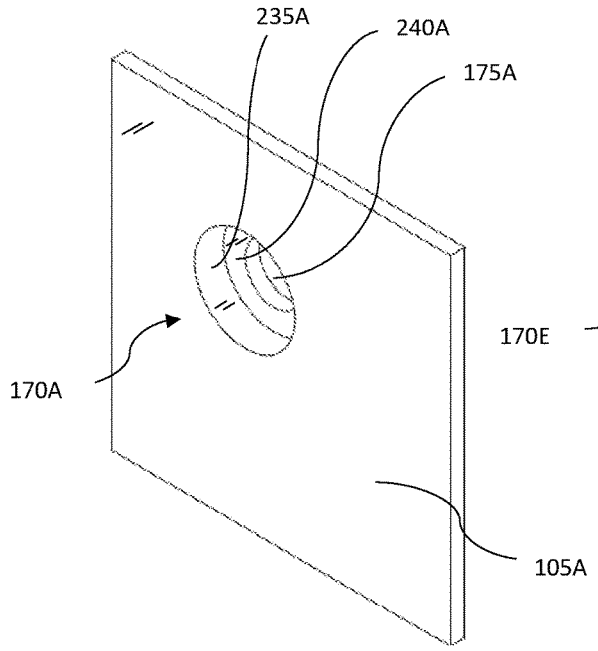
FIG. 34 is an exploded view of Section A of FIG. 33, showing an enlarged section view of a flow assembly seat according to an embodiment of the present invention.

Now referring to FIGS. 5, 10 and 33, a first side of a first core surface 105A faces the outside of a heat exchanger 100A, while the opposite side of the first side of the first core surface 105A is a second side of the first core surface 105A. The first core surface 105A may be provided with a plurality of first core panel throughholes 175A, which are orifices extending from a first side of the first core surface 105A to the second side of the first core surface 105A. On the second side of the first core surface 105A, each first core panel throughholes 175A are individually mated with a first panel flow path assembly seat 170A for the purpose of coupling individually a first longitudinal end of a flow path assemblies 155A to the first core surface 105A. The plurality of first panel flow path assembly seat surfaces 170A provided on the first core surface 105A may be provided with a flow path assembly 155A coupling surface set at a parallel angle relative to the plane established by the respective second side of the first core surface 105A in the immediate vicinity surrounding the first panel flow path assembly seat surfaces 170A, or in other embodiment of the present invention, the flow path assembly 155A coupling surface provided on the first panel flow path assembly seat surfaces 170A may not be parallel to the plane established by the respective second side of the first core surface 105A in the immediate vicinity surrounding the flow path assembly seat surfaces.

In an embodiment of the present invention, referring to FIGS. 10, 12, 14, and 16, the flow path assembly seat surfaces may be provided as a mechanism for coupling the plurality of flow path assemblies provided within the core body to the first core surface as well as to the second core surface. The flow path assembly seats may be provided in various embodiments, as shown in FIGS. 10, 11, 33, and 34, for example.

Referring now to FIG. 10, the coupling means of the plurality of flow path assemblies 155A may be provided on the first core surface 105A and on a second core surface 110A by the plurality of first panel flow path assembly seats 170A populated on the first core surface 105A and by a plurality of second panel flow path assembly seats 171A populated on the second core surface 110A, respectively. In an embodiment of the present invention, the configuration of the first panel flow path assembly seats 170A on the first core surface 105A may be symmetrically mirrored by the corresponding second panel flow path assembly seat 171A provided on the second core surface 110A. In other embodiment of the present invention, dissimilar flow path assembly seat configuration may be utilized on the first panel flow path assembly seats 170A populated on the first core surface 105A and the second panel flow path assembly seat populated on the second core surface 110A.

Referring now to FIGS. 9 and 33, the first panel flow path assembly seat 170A is a tubular member extending longitudinally outwardly from the first side of the first core surface 105A. The first panel flow path assembly seat 170A may be shown as a cylindrical member, but in other embodiment of the present invention, the shape may be in other geometric shape such as an ovoid or a rectangular parallelepiped, for example. In an embodiment of the present invention, the plurality of first panel flow path assembly seats 170A populated on the first core surface 105A may be individually paired with the first core panel throughholes 175A, an orifice extending the thickness of the first core surface 105A. In a similar fashion, the plurality of second panel flow path assembly seats 171A populated on the second core surface 110A may be individually paired with a second core panel throughholes 176A, an orifice extending the thickness of the second core surface 110A.

Figure 11:
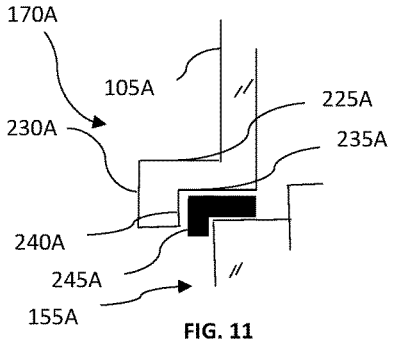
FIG. 11 is an exploded view of Section A of the heat exchanger shown in FIG. 10.

Referring to FIGS. 10 and 11, a first longitudinal end of the first panel flow path assembly seat 170A extends longitudinally outwardly out of a first side of the first core surface 105A, while a second longitudinal end of the first panel flow path assembly seat 170A is sealingly coupled to the first side of the first core surface 105A. Referring now to FIG. 11, the first longitudinal end of the first panel flow path assembly seat 170A terminates with a planar member, having an outward facing planar face of a seat exterior base 230A and an inward facing planar face of a seat interior base 240A. The seat interior base 240A may be a concentric open cylinder planar member, surface of which may be utilized to couple a first longitudinal end of the flow path assembly 155A.

The first panel flow path assembly seat 170A is provided with a seat lateral wall 225A, a cylindrical exterior surface of the outwardly extending first panel flow path assembly seat 170A, longitudinally terminating at the outward facing surface of the seat exterior base 230A. On an inside wall of the first panel flow path assembly seat 170A, opposite of the seat lateral wall 225A, is provided with a seat interior side wall 235A, a tubular surface extending longitudinally outwardly terminating at the seat interior base 240A. In order to facilitate coupling of the flow path assembly 155A to the first panel flow path assembly seat 170A, a coupling material 245A may be provided on the surface of the seat interior side wall 235A and the seat interior base 240A of the first panel flow path assembly seat 170A to couple the first longitudinal end of the flow path assembly 155A to the first core surface 105A. The coupling material may be an epoxy, adhesive, or brazing material, for example. In an embodiment of the present invention, the second core surface 110A may be provided with a plurality of second panel flow path assembly seats 171A to facilitate coupling individually a plurality of second longitudinal end of the flow path assembly 155A to the second core surface 110A, configuration of which may generally be symmetrically mirrored from the first panel flow path assembly seat 170A provided on the first core surface 105A.

Figure 12:
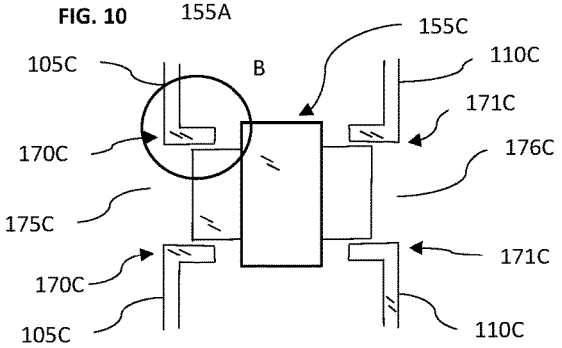
FIG. 12 is a side view showing a flow path assembly coupled within a respective flow path assembly seats provided on a first core surface and a second core surface according to another embodiment of the present invention.
Figure 13:
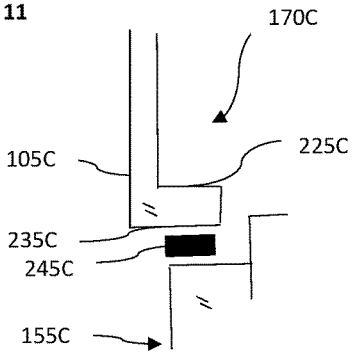
FIG. 13 is an exploded view of Section B of the heat exchanger shown in FIG. 12.

Reference is now made to FIGS. 12 and 13, in which another embodiment of a first panel flow path assembly seat 170C on a first core surface 105C and a second panel flow path assembly seat 171C on a second core surface 110C is shown. In an embodiment of the present invention, the general shape configuration utilized on the first panel flow path assembly seat 170C may generally be symmetrically mirrored on the second panel flow path assembly seat 171C. In other embodiment of the present invention, however, the general shape configuration utilized on the first panel flow path assembly seat 170C may be dissimilar from the general shape configuration utilized on the second panel flow path assembly seat 171C.

In an embodiment of the present invention, the plurality of first panel flow path assembly seat 170C provided on the first core surface 105C are individually paired with a first core panel throughholes 175C, an orifice extending the thickness of the first core surface 105C. The plurality of second panel flow path assembly seat 171C provided on the second core surface 110C are similarly individually paired with a second core panel throughholes 176C, an orifice extending the thickness of the second core surface 110C. Referring in particular to FIG. 13, the first panel flow path assembly seat 170C is a tubular member extending longitudinally inwardly from the second side of the first core surface 105C. The first panel flow path assembly seat 170C may be shown as cylindrical in shape, but in other embodiment of the present invention, the shape may be in other geometric shape such as an ovoid or a rectangular parallelepiped, for example.

The first panel flow path assembly seat 170C is provided with the seat lateral wall 225C, a first lateral side of the first panel flow path assembly seat 170C, a cylindrical surface facing the interior of the core body of the heat exchanger. A second lateral side of the first panel flow path assembly seat 170C is provided with the seat interior side wall 235C, a tubular surface, on an opposite lateral side from the seat lateral wall 225C. A tubular surface provided by the seat interior side wall 235C may be sized to matingly couple a first longitudinal end of a flow path assembly 155C. In an embodiment of the present invention, a coupling material 245C may be provided between the surface of a seat interior side wall 235C and the first longitudinal end of the flow path assembly 155C to sealingly couple the flow path assembly 155C to the first core surface 105C. The coupling material may be an epoxy, adhesive, or brazing material, for example.

Figure 14:
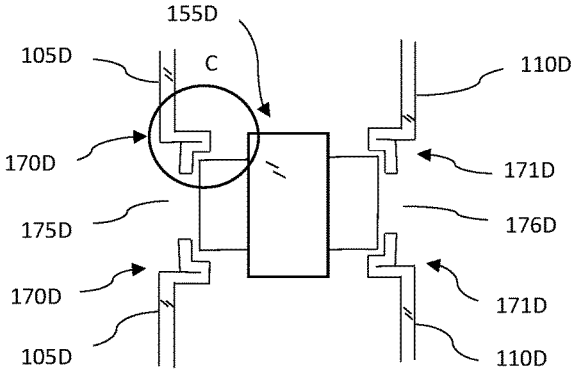
FIG. 14 is a side view showing a flow path assembly coupled within a respective flow path assembly seats provided on a first core surface and a second core surface according to yet another embodiment of the present invention.
Figure 15:
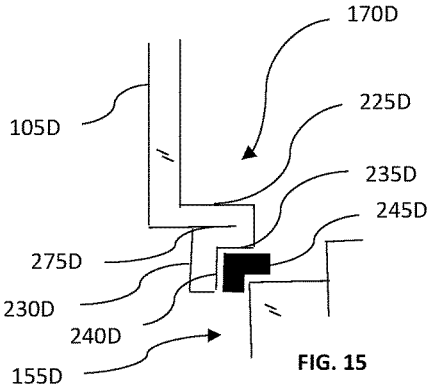
FIG. 15 is an exploded view of Section C of the heat exchanger shown in FIG. 13.

Referring now to FIGS. 14 and 15, another embodiment of a first panel flow path assembly seat 170D on a first core surface 105D and a second panel flow path assembly seat 171D on a second core surface 110D are shown. In an embodiment of the present invention, the general shape configuration of the first panel flow path assembly seat 170D may generally be symmetrically mirrored by the second panel flow path assembly seat 171D. In other embodiment of the present invention, the general shape configuration utilized on the first panel flow path assembly seat 170D may be dissimilar from the general shape configuration utilized on the second panel flow path assembly seat 171D. The plurality of first panel flow path assembly seat 170D populated on the first core surface 105D are individually paired with a first core panel throughholes 175D, an orifice extending the thickness of the first core surface 105D. The plurality of second panel flow path assembly seat 171D provided on the second core surface 110D are individually paired with a second core panel throughholes 176D, an orifice extending the thickness of the second core surface 110D.

Referring in particular to FIG. 15, a first part of the first panel flow path assembly seat 170D is a tubular member extending longitudinally inwardly from a second side of the first core surface 105D. The inward extending tubular member is provided by a seat lateral wall 225D, a cylindrical surface facing the inside of a core body of the heat exchanger. The seat lateral wall 225D may be shown as a cylindrical member, but in other embodiment of the present invention, the seat lateral wall 225D may be in other geometric shape such as an ovoid or a rectangular parallelepiped, for example. A first longitudinal end of the seat lateral wall 225D is coupled to a second side of the first core surface 105D, while a second longitudinal end of the seat lateral wall 225D extends longitudinally inwardly into the core body. After a predetermined distance, a fold is made to the material comprising the seat lateral wall 225D on into itself, generally diverting the direction opposite from the inward direction initially established by the seat lateral wall 225D sending the material now outward towards the outside of the heat exchanger. As the material makes an outward extension towards the outside, the material forms a fold onto itself, forming a seat lateral wall mating surface 275D. As the material comprising the seat lateral wall 225D is folded, the material extends outwards within the tubular structure of the seat lateral wall 225D. As a result, a new interior cylindrical shape is formed in the material in the form of a seat interior side wall 235D, the diameter of which is smaller than the diameter of the seat lateral wall 225D. In an embodiment of the present invention, the seat interior side wall 235D may be shown extending outward, but generally contained within the cylindrical member formed by the seat lateral wall 225D. In other embodiment of the present invention, the seat interior side wall 235D may extend beyond the seat lateral wall 225D, extending beyond the plane established by the first side of the first core surface 105D (Not shown).

The seat interior side wall 235D terminates with a planar surface having a first side, a seat exterior base 230D, facing the outside of the heat exchanger, and a second side, a seat interior base 240D, facing the inside of the heat exchanger. A tubular surface provided by the seat interior wall 235D may be sized to matingly couple a first longitudinal end of a flow path assembly 155D. In an embodiment of the present invention, a coupling material 245D may be provided between the surface of the seat interior side wall 235D and the seat interior base 240D provided on the first panel flow path assembly seat 170D and the first longitudinal end of the flow path assembly 155D to sealingly couple the flow path assembly 155D to the first core surface 105D. The coupling material may be an epoxy, adhesive, or brazing material, for example.

Figure 16:
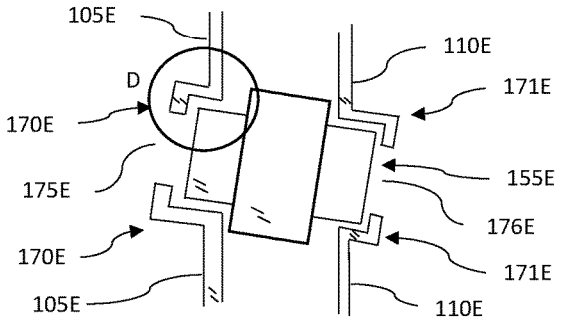
FIG. 16 is a side view showing a flow path assembly coupled within a respective flow path assembly seats provided within a first core surface and a second core surface according to another embodiment of the present invention.
Figure 17:
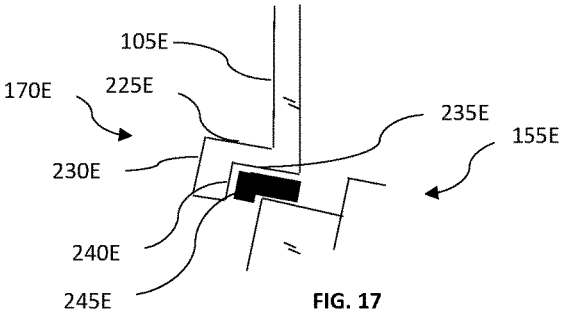
FIG. 17 is an exploded view of Section D of the heat exchanger shown in FIG. 16.
Figure 35:
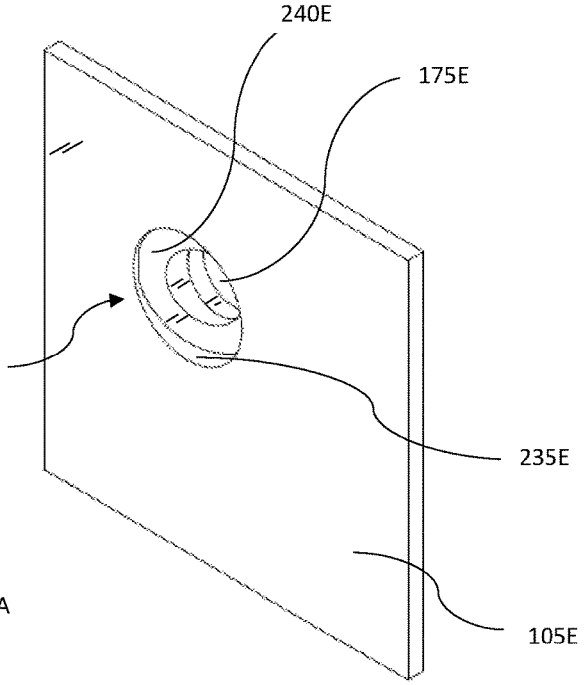
FIG. 35 is a sectional back view of another embodiment of a first core surface, showing a second side of the first core surface and a flow path assembly seat according to another embodiment of the present invention.

Now referring to FIGS. 16 and 17, a first panel flow path assembly seat 170E provided on a first core surface 105E may extend longitudinally in an outward fashion from a first side of the first core surface 105E with an axial angulation. Referring now to FIGS. 17 and 35, when an axial angulation is provided to the first panel flow path assembly seat 170E, a plane established by a seat exterior base 230E, a planar material having a thickness coupled to the leading outward longitudinal end of the flow path assembly seat 170E, may similarly be provided with an axial angulation, therefore generally leaving the plane established by the seat exterior base 230E to be not parallel to the first side of the first core surface 105E. A seat interior base 240E, a planar member opposite of the seat exterior base 230E may be parallel to the seat exterior base 230E, providing a desired effect of providing longitudinal axial angulation of a flow path assembly 155E relative to the plane established by the first side of the first core surface 105E. In other embodiment of the present invention, the lateral body of the first panel flow path assembly seat 170E provided by a seat lateral wall 225E may extend longitudinally out of the first side of the first core surface 105E with a horizontal and a vertical angulation, or in other embodiment of the present invention, with just a horizontal angulation or just a vertical angulation, for example. Interior tubular structure of the first panel flow path assembly seat 170E provided by a seat interior side wall 235E may generally be in parallel arrangement with the surface established by the seat lateral wall 225E. In an embodiment of the present invention, a corresponding second panel flow path assembly seat 171E provided on a second core surface 110E generally longitudinally align with the longitudinal axial orientation established by the first panel flow path assembly seat 170E provided on the first core surface 105E. As a result, when the flow path assembly 155E is coupled by the flow path assembly seats 170E and 171E provided respectively on the first core surface 105E and the second core surface 110E, the flow path assembly 155E is coupled at an angled with respect to the plane established generally by the first core surface 105E as well as by the second core surface 110E.

In an embodiment of the present invention, a first longitudinal end of the plurality of first panel flow path assembly seats 170 may be coupled to the second side of the first core surface 105, while a second longitudinal end of the first panel flow path assembly seats 170 may be set at a plane that is extended inward from the plane established by the second side of the first core surface 105. In other embodiment of the present invention, a first longitudinal end of the plurality of first panel flow path assembly seats 170 may extend longitudinally outwardly out of the plane established by the first side of the first core surface 105, while the second longitudinal end of the first panel flow path assembly seats 170 may be coupled to the first side of the first core surface 105. In a similar fashion, the first longitudinal end of the second panel flow path assembly seats 171 populated on the first side of the second core surface 110 may extend inwardly from the plane established by the first side of the second core surface 110, while a second longitudinal end of the second panel flow path assembly seats 171 may be coupled to the first side of the second core surface 110. In other embodiment of the present invention, the first longitudinal end of the second panel flow path assembly seats 171 may be coupled to the second side of the second core surface 110, while the second longitudinal end of the second panel flow path assembly seats 171 extend longitudinally outwardly out of the second side of the second core surface 110.

Figure 32:
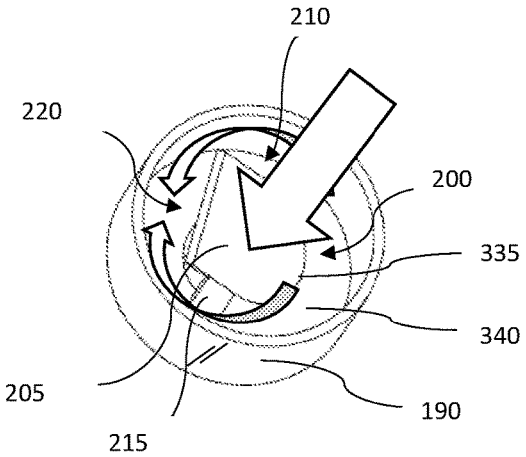
FIG. 32 is a cross-sectional view of the flow path assembly taken along the line A-A of FIG. 30, showing the heat exchange medium flow pattern indicated by arrows.

Reference is now made to FIG. 32, where interior of the flow path assembly 155 is shown. The second heat exchange medium introduced into the plurality flow path assemblies 155 encounter a plurality of obstacles that force fluid flow directional changes that disrupt heat transfer boundary layer formation, which in turn improves heat transfer effectiveness of the heat exchange medium. In a preferred embodiment of the present invention, the flow paths provided are void of secondary surface features, such as an offset fin or other structures known in the art. However, in other embodiment of the present invention, secondary surface features know in the art may be populated within or outside of the flow path assembly.

Figure 30:
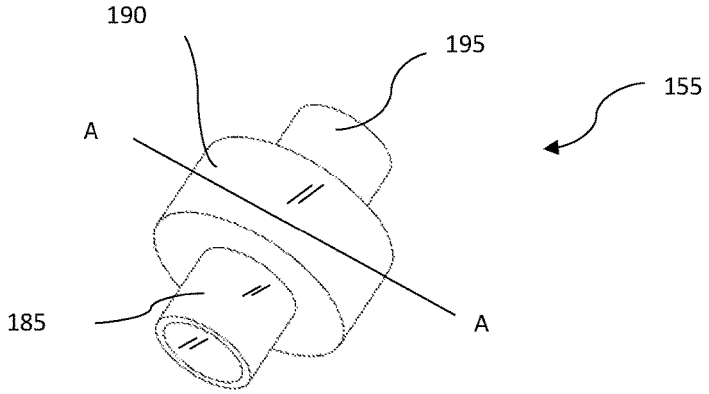
FIG. 30 is a perspective view of a flow path assembly according to an embodiment of the present invention.

Now referencing to FIG. 30, in an embodiment of the present invention, a first longitudinal end of the plurality of flow path assemblies 155 are individually provided with a first tubular section 185. The first tubular section 185 is a hollow member, permitting flow of the second heat exchange medium therethrough, while also providing coupling means for the plurality of flow path assemblies 155 to the corresponding individual first panel flow path assembly seats 170 provided on the first core surface 105. In an embodiment of the present invention, the diameter of the first tubular section 185 may be shown smaller than the diameter of a chamber section 190. In other embodiment of the present invention, the diameter of the first tubular section 185 may generally be the same as the diameter of the chamber section 190. A second longitudinal end of the plurality of flow path assemblies 155 are individually provided with the second tubular section 195. The second tubular section 195 is a hollow member, permitting flow of the second heat exchange medium therethrough, while also providing coupling means for the plurality of flow path assemblies 155 to the corresponding second panel flow path assembly seats 171 provided on the second core surface 110. In an embodiment of the present invention, the diameter of the second tubular section 195 may be shown smaller than the diameter of the chamber section 190. In other embodiment of the present invention, the diameter of the second tubular section 195 may generally be the same as the diameter of the chamber section 190. In an embodiment of the present invention, the first tubular section 185 is coupled to a first longitudinal end of the chamber section 190 while the second tubular section 195 is coupled to a second longitudinal end of the chamber section 190.

Longitudinally disposed between the first tubular section 185 and the second tubular section 195 is the chamber section 190. The chamber section 190 is a hollow member, permitting flow of the second heat exchange medium therethrough. The first tubular section 185, the chamber section 190, and the second tubular section 195 are fluidly connected to each other, permitting flow of the second heat exchange medium between respective components comprising the flow path assembly 155.

Figure 31:
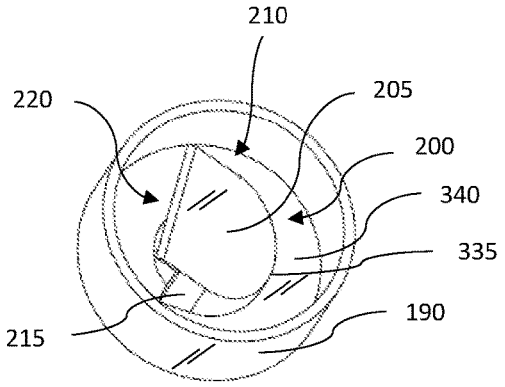
FIG. 31 is a cross-sectional view of the flow path assembly taken along the line A-A of FIG. 30.
Figure 36:
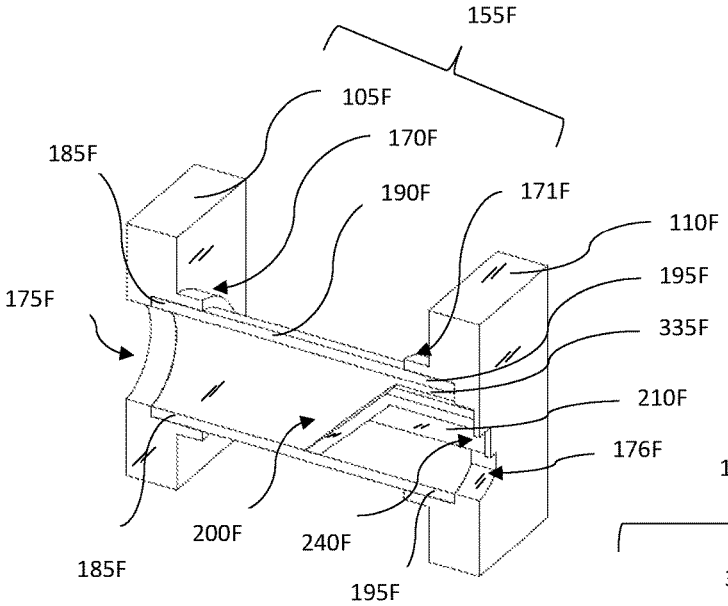
FIG. 36 is a perspective sectional view of a core body showing the inside of a flow path assembly according to another embodiment of the present invention.
Figure 38:
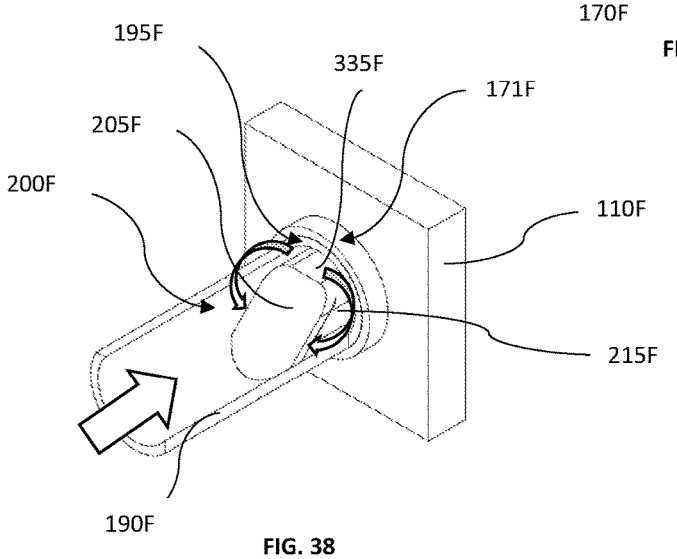
FIG. 38 is an interior perspective view of a flow path assembly coupled to a second core surface according to an embodiment of the present invention, shown by arrows expected flow of a heat exchange medium within the flow path assembly.

Referring to FIGS. 31 and 32, disposed within the chamber section 190 is a medium directing component 200. The medium directing component 200 generally functions to longitudinally partition the heat exchange medium flow space provided within the chamber section 190 into two distinct longitudinal zones, an anterior chamber section longitudinally spaced between the first core surface 105 and the medium directing component 200 and a posterior chamber section longitudinally spaced between the medium directing component 200 and a medium directing component base 340, a planar member establishing the posterior terminal end of the medium directing component 200, provided as an integral component of the chamber section 190. Referring now to FIGS. 36 and 38, in another embodiment of the present invention, the posterior chamber section may be longitudinally spaced between a medium directing component 200F and a seat interior base 240F, a planar member having a thickness, coupled to a second core surface 110F to maximize the flow space available for the second heat exchange medium to mix and agitate within the flow path assembly 155F to enhance overall heat transfer efficiency.

Referring again to FIG. 32, the medium directing component 200, having an inlet medium directing panel 205, a generally planar member facing towards the first core panel throughholes 175, further functions to disperse as well as divert the flow of the second heat exchange medium collected and staged in the anterior section of the chamber section 190. The inlet medium directing panel 205 having a planar surface set at an inclined angle relative to the longitudinal axial orientation of the chamber section 190 induces great amount of swirling and mixing effect to the second heat exchange medium within the chamber section 190 as the second heat exchange medium is directed towards the inlet medium directing panel 205, while the inclined face of the inlet medium directing panel 205 functions to simultaneously divert the flow of the second heat exchange medium in a generally vertical direction, generally following the slope of the angled face of the inlet medium directing panel 205.

The inlet medium directing panel 205 is generally free of any heat exchange medium flow restricting obstructions on its lateral edges that may restrict the amount of swirling and mixing effect occurring to the second heat exchange medium within the chamber section 190. Minimizing presence of obstruction on the inlet medium directing panel 205 further lends itself to reduce potential pressure drop effect to the flow of the second heat exchange medium, which may be detrimental to the heat transfer performance, while maintaining the beneficial effect of swirling and mixing effect to the second heat exchange medium.

After the second heat exchange medium is directed into the vertical direction within the interior of the chamber section 190 by the inlet medium directing panel 205, the second heat exchange medium is further diverted into two divergent flow patterns within the chamber section 190 in a semi-circular manner, generally symmetrical to one another (See FIG. 32). The two semi-circular flow patterns generally flow away from each other, while generally vertically axially aligned to one another, following the contour of the interior of the chamber section 190 within the posterior section of the chamber section 190, the respective flows longitudinally located between the medium directing component 200 and the medium directing component base 340. In another embodiment of the present invention, now referencing FIGS. 36 and 37, the posterior section of a chamber section 190F may be located between a medium directing component 205F and the seat interior base 240F that may be coupled to the second core surface 110F, located beyond the terminal edge of a second longitudinal end of a second tubular section 195F, whereby maximizing the interior space available within the flow path assembly 155F to facilitate further swirling and mixing effect to the second heat exchange medium, thereby enhancing the overall heat transfer performance of the heat exchanger. In an embodiment of the present invention, the seat interior base 240F may be an independent component coupled to the medium directing component 200F or the second core surface 110F. In other embodiment of the present invention, the seat interior base 240F may be provided as an integral component of the second core surface 110F or the medium directing component 200F.

Referencing back to FIG. 32, the configuration of the interior contour of the chamber section 190 along with a first lateral directing panel 210, a top directing panel 335, and a second lateral directing panel 215 directs and channels the flow of the two semi-circular flow of the second heat exchange medium originated on the anterior section of the chamber section 190 towards an outlet medium directing panel 220. The first lateral directing panel 210, the top directing panel 335, and the second lateral directing panel 215 are each respectively a generally longitudinally extended planar panel member having a material thickness. The outlet medium directing panel 220 is an inclined planar surface provided on the medium directing component 200, generally on the opposite side of the inlet medium directing panel 205. The outlet medium directing panel 220 is partially laterally abutted on a first lateral side by the first lateral directing panel 210. A second lateral side of the outlet medium directing panel 220 is partially laterally abutted by the second lateral directing panel 215. A top vertical edge of the outlet medium directing panel 220 is coupled with the top directing panel 335, while a bottom vertical end of the outlet medium directing panel 220 is coupled to the interior surface of the chamber section 190, obstructing the second heat exchange medium introduced towards the outlet medium directing panel 220 within the posterior section of the chamber section 190 from flowing back towards the anterior section of the chamber section 190, located forward of the medium directing component 200. Minimizing flow back of the second heat exchange medium reduces the pressure drop effect to the second heat exchange medium, thereby enhancing the heat transfer effectiveness of the heat exchanger 100 by extension.

Furthermore, when the second heat exchange medium is directed towards the outlet medium directing panel 220, the medium directing component 200 having the first lateral directing panel 210, the second lateral directing panel 215 and the top directing panel 335 acting as a barrier, generally merge the two semi-circular flow of the second heat exchange medium into a singular flow, while simultaneously directing the flow of the second heat exchange medium in a new longitudinal flow direction, wherein the angle of attack of the new flow direction is substantially divergent from the respective lines of flow of each semi-circular flow paths. The outlet medium directing panel 220 of the medium directing member 200 has an inclined surface, angle of which is divergent from the longitudinal axial characteristics established by the chamber section 190, generally diverting the flow of the second heat exchange medium to nearly a perpendicular flow pattern in relation to the two semi-circular flow paths, now axially aligned to the longitudinal axial characteristics of the chamber section 190, where the flow of the second heat exchange medium is further directed towards the second core panel throughholes 176 provided on the second core surface 110, where the second heat exchange medium is then discharged out of the heat exchanger 100.

In an embodiment of the present invention, a first longitudinal end respectively of the first lateral directing panel 210, the second lateral directing panel 215, and the top directing panel 335 are coupled to the outlet medium directing panel 220, while a second longitudinal end respectively of the first lateral directing panel 210, the second lateral directing panel 215, and the top directing panel 335 are coupled to the medium directing component base 340. The configuration comprising of the outlet medium directing panel 220, the first lateral directing panel 210, the second lateral directing panel 215, and the top directing panel 335 forms a channel for the second heat exchange medium, fully directing the flow of the second heat exchange medium towards the second core panel throughholes 176 provided on the second core surface 110 once the second heat exchange medium is introduced towards the posterior section of the chamber section 190, enhancing the heat transfer effectiveness by minimizing pressure drop effect to the second heat exchange medium as the second heat exchange medium is introduced within the posterior section of the chamber section 190 from the anterior section of the chamber section 190. Furthermore, the arrangement also generally prevents the second heat exchange medium to flow directly from the anterior section of the chamber section 190 to the second core panel throughholes 176 provided on the second core surface 110, thereby enhancing the performance of the heat exchanger by forcing the second heat exchange medium to flow through the stirring and mixing effect afforded by the medium directing component 200.

In an embodiment of the present invention, the flow path assembly 155 may comprise the first tubular section 185, the chamber section 190, the second tubular section 195, and the medium directing component 200 disposed within the chamber section 190. In other embodiment of the present invention, a plurality of flow path assemblies 155 as described herein may be coupled together in a serial manner. As such, the flow pattern described herein may be repeated several times dependent upon the number of the first tubular sections 185, the chamber sections 190, the second tubular section 195, and the medium directing component 200 packaged within an embodiment of the flow path assembly 155 coupled within an embodiment of a heat exchanger.

Figure 37:
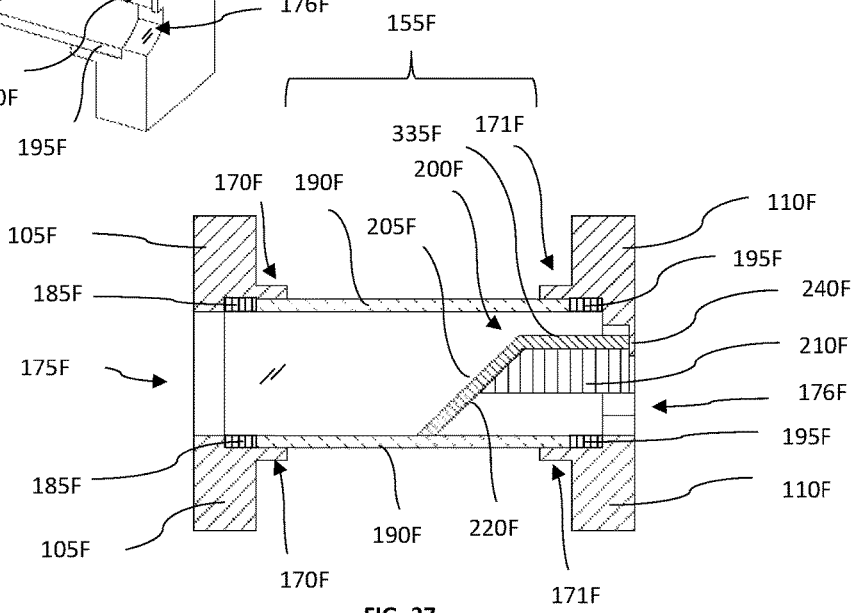
FIG. 37 is a sectional side view of the core body shown in FIG. 36.

Now, reference is made to FIGS. 35 and 37, where another embodiment of the heat exchanger 100 according to the present invention is shown. In an embodiment of the present invention, a heat exchanger 100F may be coupled with a plurality of flow path assemblies 155F within the core body 101F of the heat exchanger 100F. A first longitudinal end of the flow path assembly 155F may be a first tubular section 185F, a tubular member. The first longitudinal end of the first tubular section 185F may be sealingly coupled to a first panel flow path assembly seat 170F provided on a first core surface 105F, while a second longitudinal end of the first tubular section 185F may be sealingly coupled to the chamber section 190F. A second longitudinal end of the flow path assembly 155F may be the second tubular section 195F, a tubular member, a first longitudinal end of which may be sealingly coupled to the chamber section 190F, while a second longitudinal end of which may be sealingly coupled to a second panel flow path assembly seat 171F provided on the second core surface 110F. Longitudinally disposed between the first tubular section 185F and the second tubular section 195F is the chamber section 190F, also a tubular member. In an embodiment of the present invention, the diameter of the first tubular section 185F, the chamber section 190F, and the second tubular section 195F may be shown as generally the same. In other embodiments of the present invention, however, the diameter of the first tubular section 185F, the chamber section 190F, and the second tubular section 195F may be of dissimilar diameter from each other. Furthermore, the first tubular section 185F, the second tubular section 195F, and the chamber section 190F may be shown as cylindrical in shape. However, in other embodiment of the present invention, the respective components may take other geometric shapes, such as an ovoid or rectangular parallelepiped, for example. In some other embodiment of the present invention, the respective components comprising the flow path assembly 155F, may not share the same general geometric shape. As such the chamber section 190F may be rectangular parallelepiped, while the first tubular section 185F and the second tubular section 195F may be cylindrical in shape, for example.

Referring now to FIGS. 37 and 38, disposed within the chamber section 190F is the medium directing component 200F. A first longitudinal end of the medium directing component 200F comprise of a planer panel member having a thickness, a first side of the planar panel member having the inlet medium directing panel 205F, while a second side of the planar panel member having an outlet medium directing panel 220F. The inlet medium directing panel 205F generally faces towards a first core panel throughhole 175F provided on the first core surface 105F, while the outlet medium directing panel 220F generally faces towards a second core panel throughhole 176F provided on the second core surface 110F.

In an embodiment of the present invention, the leading edge of the first longitudinal end of the medium directing component 200F is matingly coupled to the interior surface of the chamber section 190F. As a result, the bottom vertical section of the inlet medium directing panel 205F as well the outlet medium directing panel 220F is generally terminated by the interior surface of the chamber section 190F, restricting flow of the second heat exchange medium on the bottom vertical edge of the respective panels. Coupled on the outlet medium directing panel 220F is a plurality of longitudinally extended panel members having a thickness, comprising, a first lateral directing panel 210F, a second lateral directing panel 215F, and a top directing panel 335F. A first longitudinal end of the first lateral directing panel 210F is coupled to a first lateral side of the outlet medium directing panel 220F, while a second longitudinal end of the first lateral directing panel 210F is coupled to the seat interior base 240F. A first longitudinal end of the second lateral directing panel 215F is coupled to a second lateral side of the outlet medium directing panel 220F, while a second longitudinal end of the second lateral directing panel 215F is coupled to the seat interior base 240F.

The first lateral directing panel 210F and the second lateral directing panel 215F are laterally space apart, leaving a space between the respective components. A first longitudinal end of the top directing panel 335F is coupled to the top vertical end of the outlet medium directing panel 220F while a second longitudinal end of the top directing panel 335F is coupled to the seat interior base 240F. The top directing panel 335F is laterally coupled on a first lateral side by a top vertical edge of the first lateral directing panel 210F, while laterally coupled on a second lateral side by a top vertical edge of the second lateral directing panel 215F. A bottom vertical edge respectively of the first lateral directing panel 210F and the second lateral directing panel 215F extend vertically downwardly, while the leading bottom vertical leading edge of the respective panels are disconnected from the interior surface of the chamber section 190F. As a result, a flow space for the second heat exchange medium is provided between the bottom vertical edge of the first lateral directing panel 210F and the interior surface of the chamber section 190F as well as between the bottom vertical edge of the second lateral directing panel 215F and the interior surface of the chamber section 190F, forming as a result two distinct pathways for the second heat exchange medium between the interior surface of the chamber section 190F and the medium directing component 200F. The space provided between the bottom vertical edge of the first lateral directing panel 210F and the chamber section 190F interior surface as well as the space provided between the bottom vertical edge of the second lateral directing panel 215F and the chamber section interior surface provide the two semicircular flow paths for the second heat exchange medium originating from the chamber section 190F anterior section, located forward of the medium directing component 200F.

Figure 41:
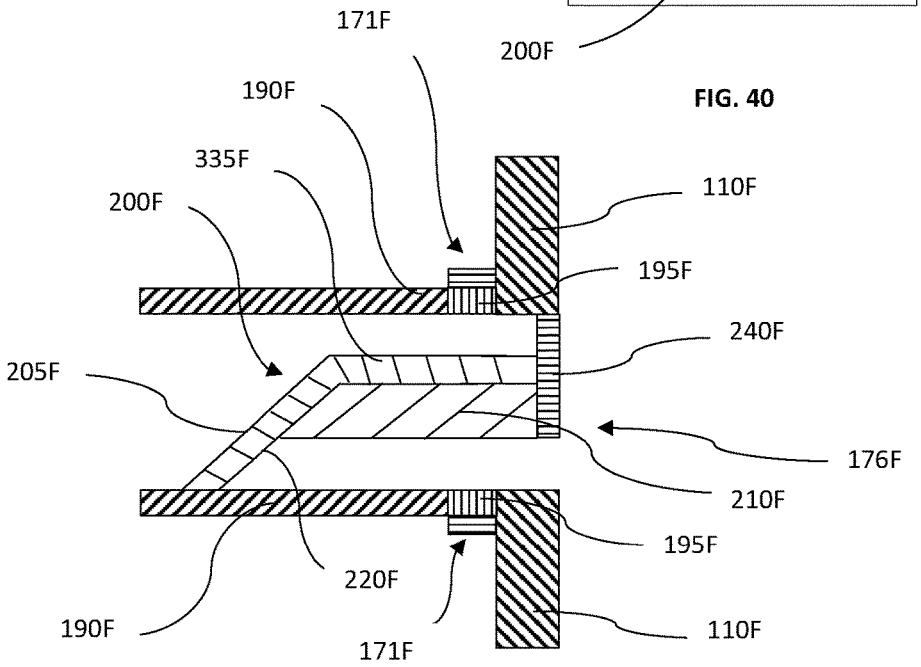
FIG. 41 is a schematic sectional side view of a flow path assembly according to an embodiment of the present invention.

Referring to FIGS. 38 and 41, the medium directing component 200F, having the inlet medium directing panel 205F, a generally planar member facing towards the first core panel throughholes 175 at an angle, generally functions to longitudinally partition the heat exchange medium flow space provided within the chamber section 190F into two distinct longitudinal zones, the anterior chamber section longitudinally spaced between the first core surface 105F and the medium directing component 200F and a posterior chamber section longitudinally spaced between the medium directing component 200F and the seat interior base 240F. The medium directing component 200F further functions to disperse as well as divert the flow of the second heat exchange medium collected and staged in the anterior section of the chamber section 190F.

The inlet medium directing panel 205F having a planar surface set at an inclined angle relative to the longitudinal axial orientation of the chamber section 190F induces great amount of swirling and mixing effect to the second heat exchange medium within the chamber section 190F as the second heat exchange medium is directed towards the inlet medium directing panel 205F, while the inclined face of the inlet medium directing panel 205F functions to simultaneously divert the flow of the second heat exchange medium in a generally vertical direction, generally following the slope of the angled face of the inlet medium directing panel 205F. The inlet medium directing panel 205F is generally free of any heat exchange medium flow restricting obstructions on its lateral edges in order to maximize the amount of swirling and mixing effect occurring to the second heat exchange medium within the chamber section 190F.

Referring to FIG. 38, after the second heat exchange medium is directed into the vertical direction within the interior of the chamber section 190F by the inlet medium directing panel 205F, the second heat exchange medium is further diverted into two divergent flow patterns within the chamber section 190F in a semi-circular manner, generally symmetrical to one another. The two semi-circular flow patterns generally flow away from each other, while generally vertically axially aligned to one another, following the contour of the interior of the chamber section 190F within the posterior section of the chamber section 190F, the respective flows longitudinally located between the medium directing component 200F and the seat interior base 240F.

The configuration of the interior contour of the chamber section 190F along with the first lateral directing panel 210F, the top directing panel 335F, and the second lateral directing panel 215F directs and channels the flow of the two semi-circular flow of the second heat exchange medium originated on the anterior section of the chamber section 190F towards the outlet medium directing panel 220F. As the first longitudinal end of the first lateral directing panel 210F, the top directing panel 335F, and the second lateral directing panel 215F are coupled to the outlet medium directing panel 220F, while the second longitudinal end of the respective panels are coupled to the seat interior base 240F (See FIGS. 40 and 41), the second heat exchange medium is restricted from directly flowing from the first core panel throughhole 175F to the second core panel throughhole 176F, without flowing through the flow regime established by the medium directing component 200F.

As the second heat exchange medium is directed towards the outlet medium directing panel 220F, the medium directing component 200F having the first lateral directing panel 210F, the second lateral directing panel 215F and the top directing panel 335F acting as a barrier, generally merge the two semi-circular flow of the second heat exchange medium into a singular flow, while simultaneously directing the flow of the second heat exchange medium in a new longitudinal flow direction, wherein the angle of attack of the new flow direction is substantially divergent from the respective lines of flow of each semi-circular flow paths. The outlet medium directing panel 220F of the medium directing member 200F has an inclined surface, angle of which is divergent from the longitudinal axial characteristics established by the chamber section 190F, generally diverting the flow of the second heat exchange medium to nearly a perpendicular flow pattern in relation to the two semi-circular flow paths, now axially aligned to the longitudinal axial characteristics of the chamber section 190F, where the flow of the second heat exchange medium is further directed towards the second core panel throughholes 176F (See FIGS. 40 and 41) provided on the second core surface 110F, where the second heat exchange medium is then discharged out of the heat exchanger 100F.

Figure 39:
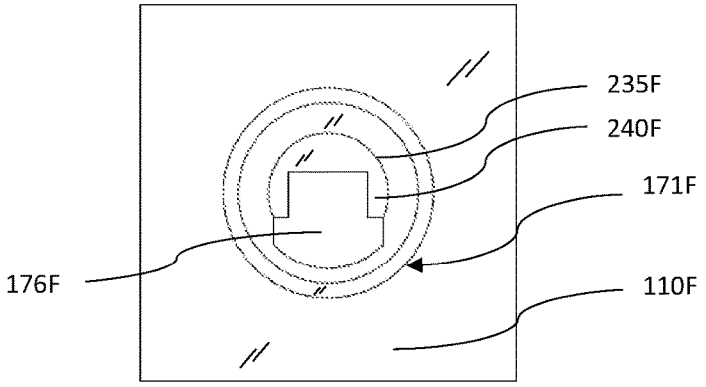
FIG. 39 is a frontal view of a second core surface along with a seat interior base according to an embodiment of the present invention.
Figure 40:
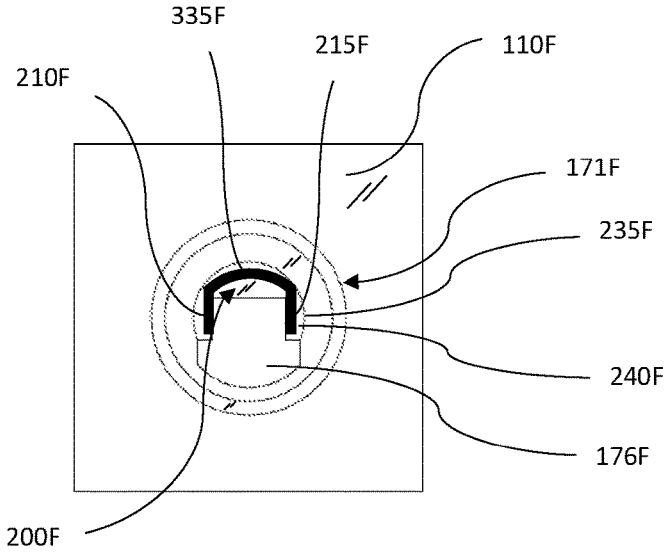
FIG. 40 is a frontal view of a second core surface along with a medium directing component coupled to a seat interior base according to an embodiment of the present invention.

Now referring to FIG. 39, the second panel flow path assembly seat 171F is shown in an embodiment of the present invention. Whereas the first core panel throughholes 175F populated on the first core surface 105F may generally be free of any panel member or other obstructing member, thereby maximizing the opening to generally match the opening provided by the first tubular section 185F, the second core panel throughholes 176F are coupled with the seat interior base 240F, a planar member having a thickness, wherein the opening provided by the second core panel throughholes 176F are distinctly reduced from the opening provided by the second tubular section 195F. Referring now to FIG. 40, the seat interior base 240F is sized and positioned to provide a posterior barrier to the second longitudinal end respectively of the first lateral directing panel 210F, the second lateral directing panel 215F, and the top directing panel 335F, thereby eliminating the possibility of the second heat exchange medium to flow directly from the first core panel throughholes 175F to the second core panel throughholes 176F, without engaging the flow regime afforded by the medium directing component 200F, thereby enhancing heat transfer effect by maximizing stirring and mixing effect to the second heat exchange medium, while minimizing pressure drop effect as a result. Furthermore, the seat interior base 240F may provide locating means of the medium directing component 200F within the chamber section 190F in a desired manner, as the seat interior base 240F provides a rigid base member for which the medium directing component 200F may engage.

Now referring to FIG. 41, the top directing panel 335F is a longitudinally extended planar member wherein the top surface facing the interior surface of the chamber section 190F is positioned vertically spaced apart from the chamber 190F while longitudinally extending from the outlet medium directing panel 220F to the seat interior base 240F, where the additional space afforded by the arrangement provides additional space for the second heat exchange medium to mix and agitate, enhancing the heat transfer performance of the heat exchanger 100F as a result. In yet another embodiment of the present invention (Not shown), the top vertical end of the top directing panel 335F may engage the interior surface of the chamber section 190F, for a desired effect. In yet further embodiment of the present invention, the top vertical surface of the top directing panel 335F may matingly engage the interior surface of the chamber section 190F to obtain a different desired effect.

The heat exchanger 100 may be utilized as a cooler, a condenser, an evaporator, a radiator, an oil cooler or any other application requiring heat to be transferred from one heat exchange medium to another heat exchange medium. The first heat exchange medium as well as the second heat exchange medium may be air, liquid, or gas, known in the art. In an embodiment of the present invention, more than one type of heat exchange medium may be utilized. Furthermore, in some embodiments of the present invention, heat exchange medium may be combined with more than one type of material, such as with air and silica gel solids to obtain additional desired features, for example.

In an embodiment of the present invention, various components comprising the heat exchanger 100 may be produced of ferrous or non-ferrous material. Similarly, the components may be made of plastics or composite materials. The various components may be produced of the same material or may be produced of dissimilar materials. Various bonding and brazing means may be utilized, which may include but not limited to adhesives, epoxy, mechanical means, or brazing and soldering, for example. In another embodiment of the present invention, various components may be welded without additional bonding material, such as in the case of laser welding. In yet another embodiment of the present invention, a portion or all the components may be manufactured by means of 3D printing technology, known in the art.

In an embodiment of the present invention, the heat exchanger 100 conducts mainly all its heat transfer between the first heat exchange medium and the second heat exchange medium by conduction means through the material comprising the plurality of flow path assemblies 155 coupled within the core body 101. As such, to facilitate excellent heat transfer effectiveness while maintaining low assembly costs, the core body 101 may be fabricated of composites or plastics material, especially desirable when utilizing manufacturing process such as with a carbon graphite composites molding technology, for example, reducing overall weight substantially with a dramatic effect while maintaining excellent heat transfer characteristics. The of plurality of flow path assemblies 155, being the main body offering heat transfer between the first heat exchange medium and the second heat exchange medium, may be produced of highly heat conductive material such as aluminum, copper, or silver, for example. Insert molding techniques know in the art may be combined with injection molding technology known in the art to manufacture the heat exchanger 100 in a cost-effective manner. Furthermore, as the plurality of flow path assemblies 155 coupled within the core body 101 act individually as longitudinal as well as vertical structural support to the heat exchanger 100, the core body 101 may be made of extremely thin material while maintaining excellent structural rigidity, offering significant weight savings as well as cost savings in raw material.

In an embodiment of the present invention, the flow path assembly seats provided on the first core surface 105 may be a simple recess or an indentation provided on a second side of the first core surface 105 to couple the first longitudinal end of the flow path assembly 155. In a similar fashion, the flow path assembly seats provided on the second core surface 110 may be a simple recess or an indentation similar to those found on the first core surface 105 to couple the second longitudinal end of the flow path assembly 155.

Many modifications and variations of the present invention are possible in light of the above teachings. Therefore, within the scope of the appended claims, the present invention may be practiced other than as specifically described.

What is claimed is:

1. A heat exchanger for exchanging heat between a first heat exchange medium and a second heat exchange medium, the heat exchanger comprising:

a core body having a first core surface establishing a frontal plane of the heat exchanger, a second core surface longitudinally spaced apart from the first core surface establishing a backward plane of the heat exchanger, a first lateral core wall sealingly coupling a first lateral edge respectively of the first core surface and the second core surface establishing a first lateral plane of the heat exchanger, a second lateral core wall coupling a second lateral edge respectively of the first core surface and the second surface establishing a second lateral plane of the heat exchanger, a top core wall sealingly coupling a top vertical edge respectively of the first core surface, the second core surface, the first lateral core wall, and the second lateral core wall establishing a top vertical plane of the heat exchanger, and a bottom core wall sealingly coupling a bottom vertical edge respectively of the first core surface, the second core surface, the first lateral core wall, and the second lateral core wall establishing a bottom vertical plane of the heat exchanger, the first core surface and the second core surface having a plurality of throughholes, each said throughhole provided on the first core surface corresponding to one of the throughholes provided on the second core surface, at least one core inlet provided on the top core wall to provide an orifice in fluid communication with the core body, at least one core outlet provided on the bottom core wall to provide an orifice in fluid communication with the core body, and a flow path assembly extending between each said first core surface throughhole and the corresponding second core surface throughhole, the flow path assembly including at least one chamber assembly, each of which is disposed between a first tubular section and a second tubular section;

each said throughhole on the first core surface mated with a first panel flow path assembly seat, a coupling mechanism engaging the first tubular section of the corresponding flow path assembly to provide locating means and longitudinal axial orientation means to the flow path assembly, each said throughhole on the second core surface mated with a second panel flow path assembly seat, a coupling mechanism engaging the second tubular section of the corresponding flow path assembly to provide locating means and longitudinal axial orientation means to the flow path assembly, each said throughhole on the first core surface in fluid communication exclusively with the corresponding flow path assembly, and each said throughhole on the second core surface in fluid communication exclusively with the corresponding flow path assembly; and each said at least one chamber assembly having a medium directing component disposed within, generally partitioning the interior space provided within the chamber assembly into at least two distinct longitudinal zones, the medium directing component including a pair of planar surfaces, comprising of an inlet directing panel and an outlet directing panel, wherein the inlet directing panel surface is at an angle with respect to the longitudinal axis of the chamber section and generally facing towards the corresponding first core surface throughhole, while the outlet directing panel surface is at an angle with respect to the longitudinal axis of the chamber section and is generally positioned on the opposite side of the inlet directing panel, and generally facing towards the corresponding second core surface throughhole, a first forward leading longitudinal end of the medium directing component engaging the interior surface of the chamber section, terminating the bottom vertical edge respectively of the inlet directing panel and the outlet directing panel, the outlet directing panel engaging a plurality of longitudinally extended panel members comprising, a first lateral directing panel, a second lateral directing panel, and a top directing panel, a first longitudinal end of the first lateral directing panel engaging a first lateral side of the outlet directing panel while a second longitudinal end engages a planar panel member, a first longitudinal end of the second lateral directing panel engaging a second lateral side of the outlet directing panel while a second longitudinal end engages the planar panel member, a first longitudinal end of the top directing panel engaging a top vertical end of the outlet directing panel while a second longitudinal end engages the planar panel member, and having a first lateral side of the top directing panel engaging a top vertical end of the first lateral directing panel while a second lateral side of the top directing panel engaging a top vertical end of the second lateral directing panel, and a bottom vertical end of the first lateral directing panel extending downwardly, while set spaced apart from the interior surface of the chamber section, and a bottom vertical end of the second lateral directing panel extending downwardly, while set spaced apart from the interior surface of the chamber section.

2. The heat exchanger of claim 1, wherein the planar panel member engaging the second longitudinal end respectively of the first lateral directing panel, the second lateral directing panel, and the top directing panel is provided as an integral component of the chamber section.

3. The heat exchanger of claim 1, wherein the planar panel member engaging the second longitudinal end respectively of the first lateral directing panel, the second lateral directing panel, and the top directing panel is provided in a form of a seat interior base, a planar member coupled to the second core surface.

4. The heat exchanger of claim 1, wherein the first core surface is provided with a radius or a plurality of radii, while the second core surface is similarly provided with a corresponding radius or a plurality of radii to mirror the shape of the first core surface.

5. The heat exchanger of claim 1, wherein the first core surface is provided with an angle or a plurality of angles, while the second core surface is similarly provided with a corresponding angle or a plurality of angles to mirror the shape of the first core surface.

6. The heat exchanger of claim 1, wherein the first core surface is provided with a combination of radii and angles, while the second core surface is similarly provided with a corresponding combination of radii and angles to mirror the shape of the first core surface.

7. The heat exchanger of claim 1, wherein the top core wall engages an inlet tank.

8. The heat exchanger of claim 1, wherein the bottom core wall engages an outlet tank.

9. The heat exchanger of claim 1, wherein each throughholes provided on the first core surface is axially aligned with the corresponding throughhole on the second core surface.

10. The heat exchanger of claim 1, wherein the core body is comprised of plastics or composites material, while the plurality of flow path assemblies are comprised of ferrous or non-ferrous material.

11. The heat exchanger of claim 3, wherein each throughhole provided on the second core surface is distinctly smaller in opening surface area than the opening surface area provided by the corresponding throughhole on the first core surface.

12. The heat exchanger of claim 11, wherein the core body is comprised of plastics or composites material, while the plurality of flow path assemblies are comprised of ferrous or non-ferrous material.

* * * * *